US009862559B2

(12) United States Patent
Suzuki et al.

(10) Patent No.: US 9,862,559 B2
(45) Date of Patent: Jan. 9, 2018

(54) SHEET DETECTION DEVICE, SHEET CONVEYANCE DEVICE, AND IMAGE FORMING APPARATUS

(71) Applicant: CANON KABUSHIKI KAISHA, Tokyo (JP)

(72) Inventors: Masato Suzuki, Mishima (JP); Takashi Yano, Mishima (JP); Takateru Ohkubo, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/338,130

(22) Filed: Oct. 28, 2016

(65) Prior Publication Data

US 2017/0121137 A1 May 4, 2017

(30) Foreign Application Priority Data

Nov. 4, 2015 (JP) ..... 2015-216674

(51) Int. Cl.
*B65H 7/02* (2006.01)
*B65H 7/14* (2006.01)
(Continued)

(52) U.S. Cl.
CPC ..... *B65H 7/14* (2013.01); *B65H 3/34* (2013.01); *G03G 15/6529* (2013.01);
(Continued)

(58) Field of Classification Search
CPC B65H 7/02; B65H 2553/41; B65H 2553/412; B65H 2553/60; B65H 2553/61; B65H 2553/612; B65H 2553/80; B65H 2553/81; B65H 2553/82; B65H 2553/83; B65H 7/14; B65H 43/08
See application file for complete search history.

(56) References Cited

U.S. PATENT DOCUMENTS 8,833,753 B2 * 9/2014 Araishi ..... B65H 7/02 271/10.02
9,242,823 B2 * 1/2016 Iizuka ..... B65H 7/08
(Continued)

FOREIGN PATENT DOCUMENTS

JP 9-183539 A 7/1997
JP 2004-131221 A 4/2004
(Continued)

*Primary Examiner* — Jeremy R Severson
(74) *Attorney, Agent, or Firm* — Canon U.S.A., Inc. IP Division

(57) ABSTRACT

A sheet detection unit includes a photo-interrupter, a shutter holder, and shutter members held to be movable relative to the shutter holder. The shutter members include a sheet rear end detection portion capable of switching an optical axis between a light-interrupted state and a light-transmitted state and each are supported to be movable to an abutment position where the shutter member causes an abutment surface to protrude, and also movable to a retracted position where the shutter member is retracted from a sheet conveyance path. Based on a detection signal output from the photo-interrupter by the sheet front end detection portion and the sheet rear end detection portion moving relative to the optical axis, a control unit determines the presence or absence of a sheet.

13 Claims, 17 Drawing Sheets

(51) Int. Cl.
*G03G 15/00* (2006.01)
*B65H 3/34* (2006.01)

(52) U.S. Cl.
CPC .. *B65H 2553/412* (2013.01); *B65H 2553/612* (2013.01); *B65H 2553/81* (2013.01); *B65H 2801/12* (2013.01)

(56) References Cited

U.S. PATENT DOCUMENTS

| | | | | |
|---|---|---|---|---|
| 9,637,336 | B2 * | 5/2017 | Mizuno | B65H 5/062 |
| 2005/0133992 | A1 * | 6/2005 | Ueng | B65H 7/02<br>271/265.01 |
| 2009/0129790 | A1 * | 5/2009 | Kang, II | G03G 15/6502<br>399/23 |

FOREIGN PATENT DOCUMENTS

| | | | |
|---|---|---|---|
| JP | 2005-154073 | A | 6/2005 |
| JP | 2013-177244 | A | 9/2013 |

* cited by examiner

SHEET DETECTION DEVICE, SHEET CONVEYANCE DEVICE, AND IMAGE FORMING APPARATUS

BACKGROUND OF THE INVENTION

Field of the Invention

The present invention relates to a sheet detection device, a sheet conveyance device, and an image forming apparatus capable of detecting a position of a conveyed sheet.

Description of the Related Art

Generally, to match the timing for conveying a sheet to an image transfer position and the timing for conveying an image formed at an image forming portion to the image transfer position, an image forming apparatus includes in a sheet conveyance path a sheet detection device capable of detecting the position of the front end of a sheet. This sheet detection device can also be used to determine the arrival timing of a sheet or the length of a sheet, or detect a jam (paper jam).

Further, in the image forming apparatus, the recording position of an image relative to the position of a sheet is an important factor for image quality. Japanese Patent Application Laid-Open No. 9-183539 discusses an image forming apparatus in which a skew correction unit is provided to improve the accuracy of the recording position of an image. In this image forming apparatus, a skew correction unit using shutter members is disposed in a pair of conveyance rollers immediately before an image transfer portion. In or downstream of the skew correction unit, a sheet detection device for detecting a sheet is disposed.

Conventionally, as a pair of conveyance rollers immediately before an image transfer portion, there is a pair of conveyance rollers set to be able to convey a sheet without being influenced by the conveying speed of another pair of conveyance rollers disposed upstream of this pair of conveyance rollers. A sheet detection device is disposed in a nip portion of the pair of conveyance rollers or downstream of the pair of conveyance rollers, thereby, in synchronized timing with an image formed by an image forming portion, adjusting the speed of a sheet or outputting a signal for the image forming portion to start forming an image. As described above, the skew of a sheet is corrected by shutter members, conveyance is controlled based on detection by a sheet detection device, and the timing of image formation is controlled, whereby it is possible to achieve an image forming apparatus in which the accuracy of the recording position is high.

In recent years, an image forming apparatus has been demanded to further increase the number of sheets in image formation per unit time. As an example thereof, there is a method for reducing the distance between the rear end of a preceding sheet and the front end of a following sheet (hereinbelow referred to as a "sheet-to-sheet distance"). With the reduction of the sheet-to-sheet distance, a sheet detection device needs to increase its responsiveness to detect a short sheet-to-sheet distance.

In the apparatus discussed in Japanese Patent Application Laid-Open No. 9-183539, however, each shutter member in a registration shutter mechanism is set to rotate by a certain angle in a counterclockwise direction about a roller shaft from when the shutter member stands by for a sheet to when the sheet passes through the shutter member. After the rear end of a preceding sheet passes through the shutter member and until the shutter member returns to the standby state, a return time corresponding to the certain angle is required. For the length of this return time, it is not possible to cause a following sheet to enter the registration shutter. Thus, according to this configuration, the return time of the shutter member hinders the reduction of the sheet-to-sheet distance.

SUMMARY OF THE INVENTION

An embodiment is directed to a sheet detection device, a sheet conveyance device, and an image forming apparatus capable of reducing the sheet-to-sheet distance between a preceding sheet and a following sheet.

According to an aspect of the present invention, a sheet detection device configured to detect a sheet conveyed through a sheet conveyance path includes an output device configured to output a detection signal that varies by switching the output device between a light-interrupted state where an optical path is interrupted and a light-transmitted state where the optical path is not interrupted, an abutment member including an abutment surface for abutting a front end of the conveyed sheet, a holding member including a first positioning portion and configured to hold the abutment member, and a detection unit configured to detect presence or absence of the sheet based on the detection signal output from the output device, wherein the holding member includes a first flag portion capable of switching the optical path between the light-interrupted state and the light-transmitted state, wherein the abutment member includes a second flag portion capable of switching the optical path between the light-interrupted state and the light-transmitted state, wherein the abutment member is movable to an abutment position at which the abutment surface abuts on the front end of the sheet, and is positioned relative to the first positioning portion, and also movable to a retracted position at which the abutment surface does not abut on the front end of the sheet, wherein the holding member is movable to a positioned first position and a second position retracted from the first position, wherein, in a standby state where the abutment member is located at the abutment position and the holding member is located at the first position, the abutment surface is pushed by the front end of the sheet whereby, in a state where the abutment member is positioned by the first positioning portion, the holding member moves in a direction away from the first position, and wherein the holding member moves in the direction away from the first position and thereby causes the front end of the sheet to separate from the abutment surface, whereby, in a state where the abutment member is pushed by a surface of the sheet and thereby moves to the retracted position, the holding member moves from the second position to the first position and, based on the detection signal output from the output device by the first flag portion and the second flag portion moving relative to the optical path with movements of the abutment member and the holding member, the detection unit detects the presence or absence of the sheet.

Further features of the present invention will become apparent from the following description of exemplary embodiments with reference to the attached drawings.

DESCRIPTION OF THE EMBODIMENTS

Figure 1:
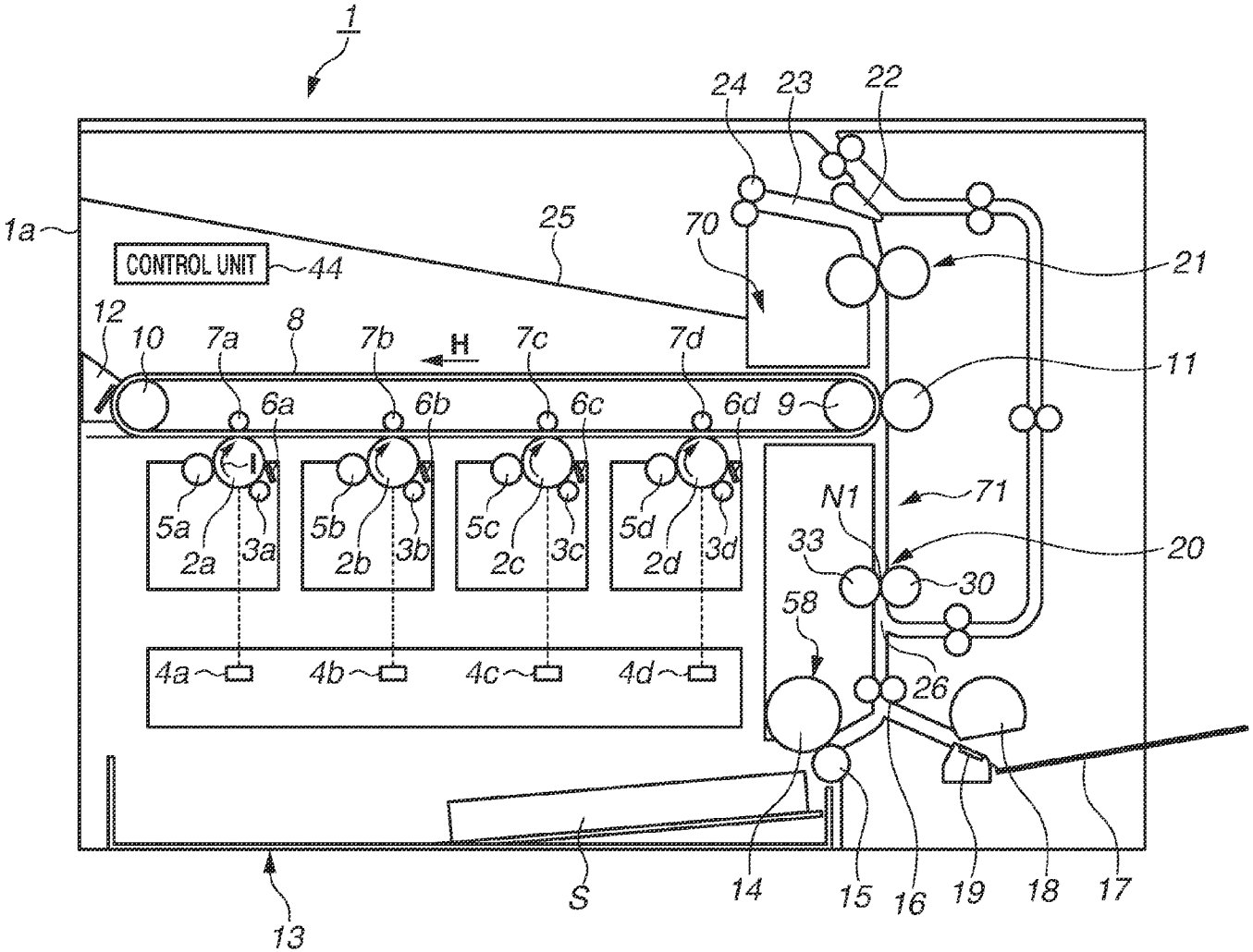
FIG. 1 is a cross-sectional view schematically illustrating a configuration of an image forming apparatus according to a first exemplary embodiment.

Exemplary embodiments will be described in detail below with reference to the drawings. FIG. 1 is a cross-sectional view illustrating a configuration of a color electrophotographic image forming apparatus according to a first exemplary embodiment.

<Image Forming Apparatus>

An image forming apparatus 1 includes an image forming apparatus main body (hereinbelow referred to as an "apparatus main body") 1*a*. In the apparatus main body 1*a*, four drum-like image bearing members provided side by side in an approximately horizontal direction (i.e., photosensitive drums 2*a*, 2*b*, 2*c*, and 2*d* (hereinbelow, integrally referred to as a photosensitive drum 2)) are disposed as image bearing members. The photosensitive drum 2 is driven to rotate in the clockwise direction in FIG. 1 (i.e., direction indicated by an arrow I) by a driving unit (not illustrated). In the apparatus main body 1*a*, charging devices 3*a*, 3*b*, 3*c*, and 3*d* (hereinbelow, integrally referred to as a charging device 3), which uniformly charges the surface of the photosensitive drum 2, and scanner units 4*a*, 4*b*, 4*c*, and 4*d* (hereinbelow, integrally referred to as a scanner unit 4), each of which emits a laser beam based on image information to form an electrostatic latent image on the photosensitive drum 2, are disposed. In the apparatus main body 1*a*, developing devices 5*a*, 5*b*, 5*c*, and 5*d* (hereinbelow, integrally referred to as a developing device 5), each of which applies toner including developer to the electrostatic latent image to develop a toner image, and cleaning devices 6*a*, 6*b*, 6*c*, and 6*d* (hereinbelow, integrally referred to as a cleaning device 6, each of which removes transfer residual toner remaining on the surface of the photosensitive drum 2 after transfer, are disposed.

In the image forming apparatus 1 according to the present exemplary embodiment, the photosensitive drum 2, the charging device 3, the developing device 5, and the cleaning device 6 are configured as an integrated cartridge unit. The image forming apparatus 1 forms images of different colors (yellow, cyan, magenta, and black) using an electrophotographic recording method.

A primary transfer roller 7 (i.e., primary transfer rollers 7*a*, 7*b*, 7*c*, 7*d*) as a primary transfer unit abuts on the photosensitive drum 2 via an intermediate transfer belt 8 and primarily transfers the toner image on the photosensitive drum 2 onto the intermediate transfer belt 8. The intermediate transfer belt 8 is stretched between a driving roller 9 and a tension roller 10 and rotated in a counterclockwise direction (direction illustrated by an arrow H) by the driving of the driving roller 9. A secondary transfer roller 11 as a secondary transfer unit is disposed at a position opposing the driving roller 9 via the intermediate transfer belt 8 and secondarily transfers to a sheet S the toner image transferred onto the intermediate transfer belt 8. Further, at a position opposing the tension roller 10 via the intermediate transfer belt 8, an intermediate transfer belt cleaning device 12 is disposed, which removes and collects transfer residual toner remaining on the surface of the intermediate transfer belt 8.

A sheet conveyance device 71 for conveying the sheet S includes a sheet feeding cassette 13 disposed in the lowest portion of the device, a multi-feeding unit 17 disposed in a lower right portion of the device, a pair of registration rollers 20, and a registration shutter unit 35 (see FIG. 2) for correcting the skew of the sheet S. The pair of registration rollers 20 includes a driving roller 30, which includes a plurality of roller main bodies 31 (see FIG. 2) supported by a roller shaft 32 (see FIG. 2), and a plurality of driven rollers 33, which are opposed to and abut on the respective roller main bodies 31. To the roller shaft 32, the rotation of a driving motor 28 (see FIG. 3) the driving of which is controlled by a control unit 44 (see FIG. 3), is input.

Downstream of the secondary transfer roller 11 in a sheet conveyance direction, a fixing unit 21 is disposed as a fixing unit for fixing the toner image formed on the sheet S via the intermediate transfer belt 8 by the image forming portions for the respective colors. Downstream of the fixing unit 21, a conveyance path switching member 22 is disposed, which guides the sheet S to a discharge conveyance path 23 when one-sided printing is performed. Downstream of the conveyance path switching member 22, a pair of discharge rollers 24 is disposed, which discharges the sheet S to a discharge tray 25 serving as a sheet stacking unit. An image forming unit 70, which forms an image on a sheet detected by a photo-interrupter (output device) 40 (see FIG. 3), includes the above image forming portions, the secondary transfer roller 11, and the fixing unit 21.

<Operation of Image Forming Apparatus>

Next, operation of the image forming apparatus 1 is described. Sheets S stacked on the sheet feeding cassette 13 are separated and fed one by one by a pair of separation feed rollers 58, which includes a feed roller 14 and a separation roller 15. Then, each sheet S is conveyed to a pair of pull-out rollers 16. Further, similarly, sheets S stacked on the multi-feeding unit 17 are separated one by one by a semicircular feed roller 18 and a separation pad 19. Then, each sheet S is conveyed to the pair of pull-out rollers 16. The sheet S is conveyed by the pair of pull-out rollers 16 to the pair of registration rollers 20 and conveyed to an abutment portion between the intermediate transfer belt 8 and the secondary transfer roller 11.

Toner images having been transferred on the intermediate transfer belt 8 by the image forming portions for the respective colors are transferred onto the sheet S in the abutment portion (a transfer unit) between the intermediate transfer belt 8 and the secondary transfer roller 11, thereby forming a color image. Then, the sheet S is conveyed to the fixing unit 21. The fixing unit 21 applies heat and pressure to the toner image transferred onto the sheet S. Consequently, the sheet S to which the toner image of a plurality of colors is fixed is guided by the conveyance path switching member 22 to the discharge conveyance path 23 side and discharged to the discharge tray 25 via the pair of discharge rollers 24.

<Registration Shutter Unit>

Figure 2:
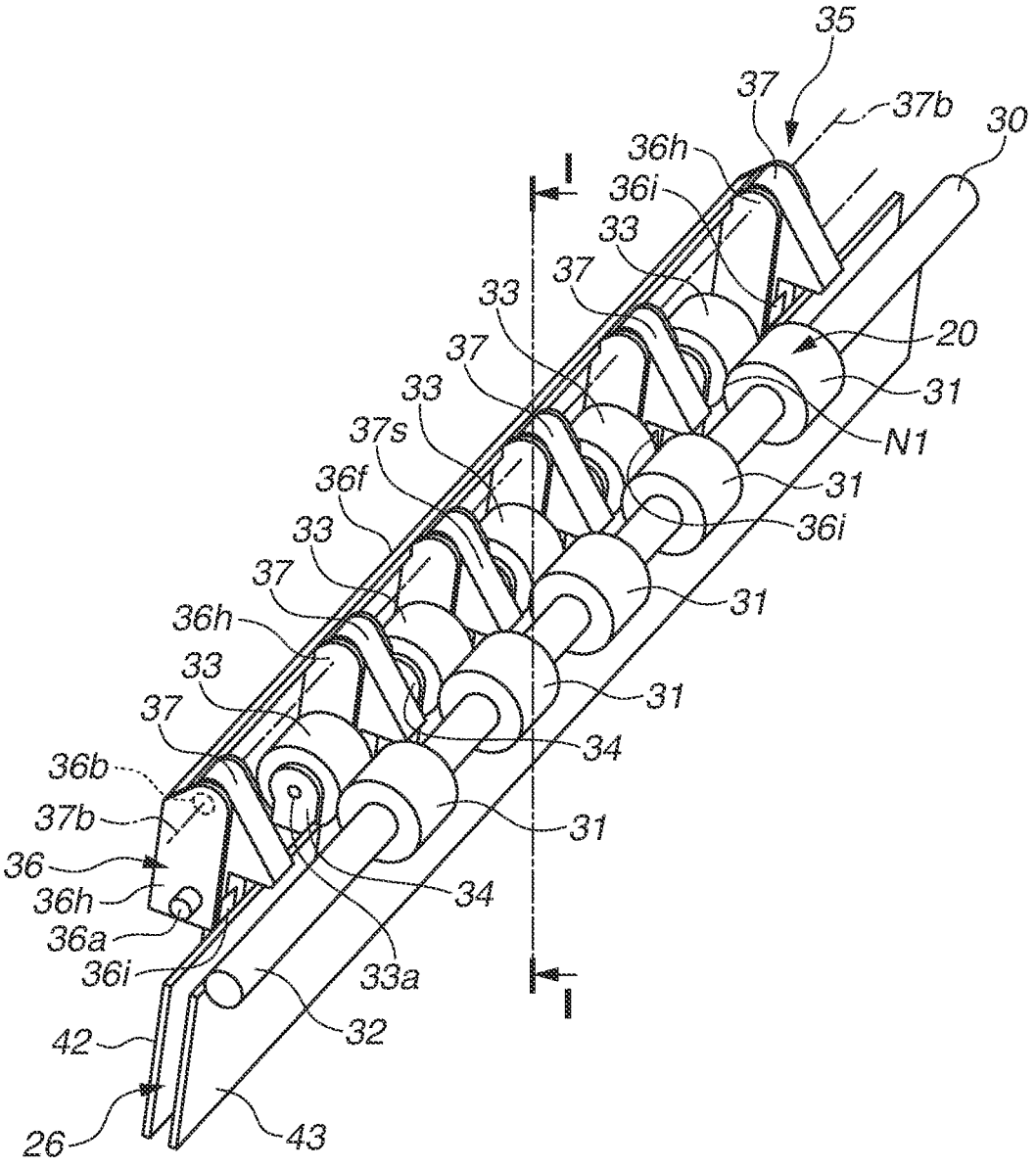
FIG. 2 is a perspective view illustrating an overall configuration of a registration shutter unit according to the first exemplary embodiment.
Figure 3:
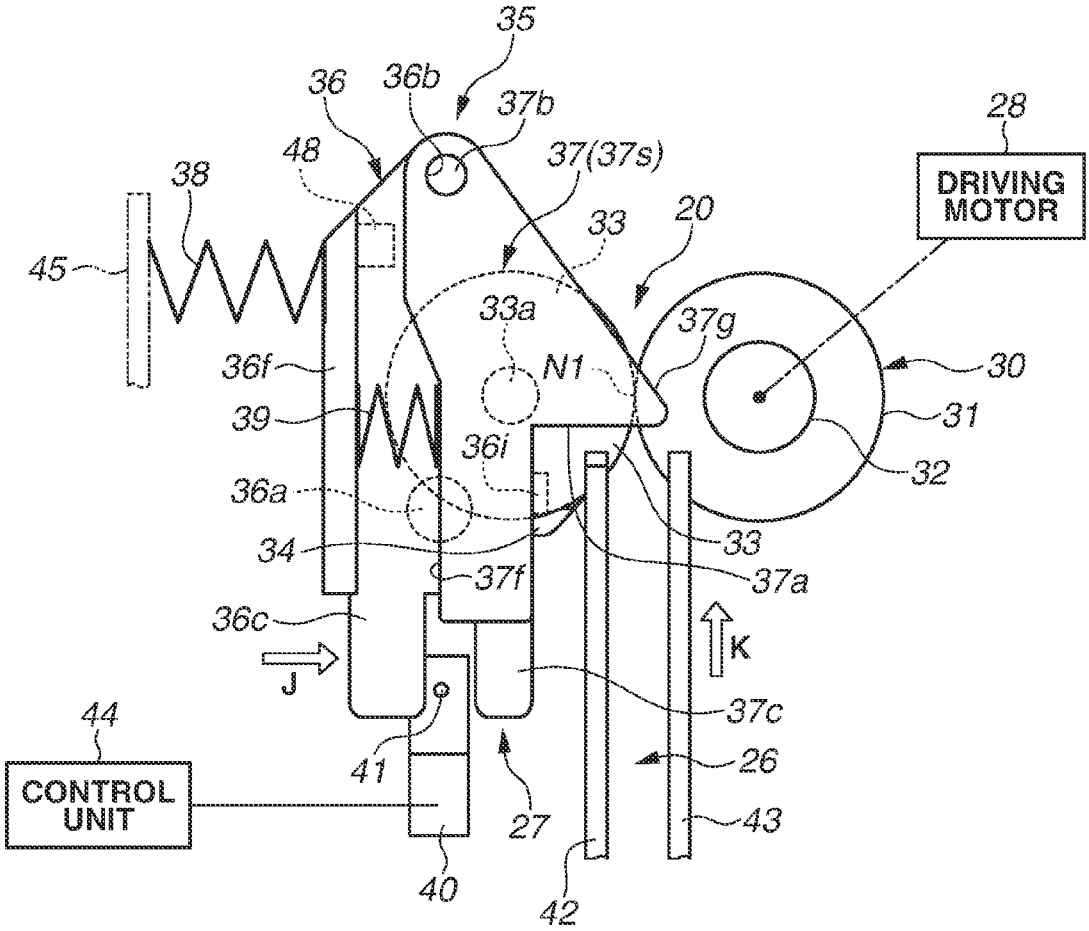
FIG. 3 is a cross-sectional view illustrating an entire configuration of the registration shutter unit according to the first exemplary embodiment.

Next, with reference to FIGS. 2 and 3, a description is given of a registration shutter unit 35 as a skew correction unit in the image forming apparatus 1 according to the present exemplary embodiment, and the peripheral configuration of the registration shutter unit 35. FIG. 2 is a perspective view illustrating an overall configuration of the registration shutter unit 35. FIG. 3 is a cross-sectional view illustrating an entire configuration of the registration shutter unit.

To improve the accuracy of the recording position of an image, the registration shutter unit (skew correction unit) 35 illustrated in FIG. 2 is disposed near the pair of registration rollers 20 immediately before the abutment portion (the transfer unit) between the intermediate transfer belt 8 and the secondary transfer roller 11 in FIG. 1. The registration shutter unit 35 includes a shutter holder 36 as a holding member, shutter members 37 as a sheet abutment member, a holder biasing spring 38 as a first biasing member, and shutter biasing springs 39 as a second biasing member.

As illustrated in FIG. 2, the pair of registration rollers 20 includes a driving roller 30 and driven rollers 33 held by driven roller holders 34. The driving roller 30 includes a roller shaft 32 made of a metal, a plurality of (five in the present exemplary embodiment) roller main bodies 31, which are supported at predetermined intervals in the axial direction of the roller shaft 32. The driven rollers 33 are supported to be rotatable about rotating shafts 33*a* by a plurality of (five in the present exemplary embodiment) driven roller holders 34 disposed in the axial direction of the respective roller main bodies 31 to oppose the respective roller main bodies 31.

Each driven roller holder 34 is biased by a roller spring (not illustrated) for the driving roller 30. Each driven roller 33, which is rotatable about the rotating shaft 33*a*, is pressed with a certain force by the opposed roller main body 31 due to the spring pressure of the roller spring, thereby forming a nip portion N1. In the present exemplary embodiment, in consideration of various sheet width sizes, five nip portions N1 are provided in the longitudinal direction of the apparatus main body 1*a*.

As illustrated in FIGS. 2 and 3, the shutter holder (holding member) 36 is axially supported to be pivotable relative to a feeding frame (not illustrated) in the state of axially supporting a plurality of (six in the present exemplary embodiment) shutter members 37 to be pivotable along the axial direction. The shutter holder 36 is configured to pivot integrally with the plurality of shutter members 37 by connecting the shutter members 37 in a same phase in the longitudinal direction of the shutter holder 36. The plurality of shutter members 37 is disposed to be adjacent to the driven rollers 33. If subjected to the reaction force of the sheet S, each of the plurality of shutter members 37 pivots in the direction of an arrow C (see FIG. 6B).

The shutter holder 36 is supported to be pivotable around a pivotal shaft 36*a* serving as a support point disposed outside a sheet conveyance path 26, and a spring abutment portion 36*f* of the shutter holder 36 is biased to the driving roller 30 side by the holder biasing spring 38. In the present exemplary embodiment, a shutter member 37*s*, together with the other shutter members 37, causes the front end of the sheet S conveyed from the upstream side to abut on an abutment surface 37*a*, thereby correcting the skew of the sheet S. However, different from the other shutter members 37, the shutter member 37*s* includes a sheet rear end detection portion 37*c* protruding downward from the lowest portion of the shutter member 37*s*. In a part opposing the back surface of the shutter member 37*s*, the shutter holder 36 includes a sheet front end detection portion 36*c* protruding downward from the lowest portion of the shutter holder 36 to be adjacent to the sheet rear end detection portion 37*c*.

The shutter holder 36 is supported to be movable to a close position (see FIG. 5A) where the shutter holder 36 is close to the sheet conveyance path 26, and to a separation position (see FIG. 6A) where the shutter holder 36 is separate from the sheet conveyance path 26. Similar to the sheet rear end detection portion 37*c* as a second flag portion, the sheet front end detection portion 36*c* as a first flag portion switches an optical axis (optical path) 41 of a photo-interrupter 40 between a light-interrupted state and a light-transmitted state according to the presence or absence of the sheet S passing therebetween. The photo-interrupter 40 forms an output device for outputting a detection signal that changes by switching the photo-interrupter 40 between a light-interrupted state where the optical axis 41 is interrupted and a light-transmitted state where the optical axis 41 is not interrupted.

At both end portions of the shutter holder 36 in the longitudinal direction, the pivotal shafts 36*a* are provided. The pivotal shafts 36*a* support the entire shutter holder 36 formed to be longer in the axial direction, to be pivotable in the clockwise and counterclockwise directions in FIGS. 2 and 3. Further, the shutter holder 36 includes pairs of holding members 36*h*, which are provided at predetermined intervals in the longitudinal direction. In each pair of holding members 36*h*, a shutter member 37 supported at its pivotal spindle 37*b* dispose at its upper portion by pivotal center holes 36*b*, which are provided in upper portions of the holding members 36*h*, is disposed to be pivotable.

As illustrated in FIG. 3, the shutter holder 36 is biased to the driving roller 30 side by the holder biasing spring (first biasing member) 38 in the state where the pivotal shaft 36*a* at both end portions are axially supported to be pivotable relative to the feeding frame (not illustrated). The holder biasing spring 38 is a compression spring provided in a contracted manner between the spring abutment portion 36*f*, which is a back surface corresponding to each shutter member 37, and a feeding frame portion 45 on the apparatus main body 1*a* side. The holder biasing spring 38 presses the spring abutment portion 36*f* to cause the shutter holder 36 to pivot about the pivotal shafts 36*a* in the clockwise direction in FIG. 3. The shutter holder 36 is biased from the separation position (see FIG. 6A) toward the close position (see FIG. 5A) in the state of holding the shutter member 37 by the holder biasing spring 38. Then, the shutter holder 36 is held at the close position (see FIG. 5A) in the state of abutting on a feeding frame abutment portion 48 on the apparatus main body 1*a* side.

The biasing force of each shutter biasing spring (second biasing member) 39 is set to be weaker than that of the holder biasing spring 38. The shutter biasing spring 39 biases, from a standby position (see FIG. 6B) toward a protruding position (see FIG. 6C), the shutter member 37 held to be movable relative to the shutter holder 36. The shutter biasing spring 39 biases the shutter members 37 in the direction indicated by an arrow B (FIG. 5B) with a force weaker than the moment of the reaction force of the sheet S. Further, also in the state illustrated in FIG. 6B, the biasing force of the holder biasing spring 38 is set to be stronger than the biasing force of the shutter biasing spring 39 so that the biasing force of the holder biasing spring 38 overcomes the biasing force of the shutter biasing spring 39 and pushes back the shutter holder 36 to the close position.

Each shutter member 37 is held to be movable relative to the shutter holder 36 and supported to be movable to a protruding position, a retracted position, and a standby position. The protruding position is a position where the shutter member 37 causes the abutment surface 37*a* to protrude from the shutter holder 36 at the close position to the sheet conveyance path 26. The retracted position is a position where the shutter member 37 is retracted from the sheet conveyance path 26 together with the shutter holder 36 moved to the separation position. The standby position is a position where the shutter member 37 is prepared to protrude to the sheet conveyance path 26 in the state of being retracted from the sheet conveyance path 26 after moving relative to the shutter holder 36 at the close position by the reaction force of the sheet S.

As illustrated in FIGS. 2 and 3, the plurality of shutter members 37 include the shutter member 37*s*, which is disposed at a position closer to the center than a sheet minimum size. Each of the plurality of shutter members 37 is supported so that an upper portion of the shutter member 37 pivots relative to the pivotal center holes 36*b* of the shutter holder 36 using a pivotal spindle 37*b* as a pivot support. The pivotal spindle 37*b* is disposed downstream, in the sheet conveyance direction (the direction indicated by an arrow K), of the pivotal shafts 36*a*, which are disposed outside the sheet conveyance path 26. Each of the plurality of shutter members 37 including the shutter member 37*s* at the position closer to the center includes a protruding portion 37*g*, which is an apex protruding at a predetermined angle from a center portion of the shutter member 37 in the up-down direction in FIG. 3 to the driving roller 30 side. Each shutter member 37 includes, on the underside of the protruding portion 37*g*, the abutment surface 37*a*, which is formed linearly to extend in a direction (the left-right direction in FIG. 3) approximately orthogonal to the sheet conveyance direction (the direction indicated by the arrow K).

The abutment surface 37*a* is located slightly upstream (on the lower side of FIG. 3) of a nip portion N1 of the pair of registration rollers 20. When the front end of a sheet abuts on the abutment surface 37, the abutment surface 37*a* corrects the skew of the sheet, then sends the sheet to the nip portion N1 to nip the sheet. As described above, when the sheet S is conveyed through the sheet conveyance path 26 and having passed through the abutment surface 37*a* while abutting on the abutment surface 37*a*, the pair of registration rollers 20 conveys the sheet S downstream in the sheet conveyance direction while nipping the sheet S at the nip portion N1. Then, at the protruding position, the shutter member 37 can send a sheet to the nip portion N1 while correcting the skew of the sheet by abutting the front end of the sheet to the abutment surface 37*a* located immediately upstream the nip portion N1.

As illustrated in FIG. 3, between a spring abutment portion 37*f* of each of the shutter members 37 including the shutter member 37*s* and the spring abutment portion 36*f* of the shutter holder 36, a shutter biasing spring 39, one end of which is caused to abut on the spring abutment portion 37*f* and the other end is caused to abut on the spring abutment portion 36*f*, is provided in a contracted manner. The shutter biasing spring 39 is made of a compression spring and presses the shutter member 37 to rotate in a counterclockwise direction (the direction indicated by the arrow B in FIG. 5B). The shutter member 37 is axially supported to be pivotable about a pivotal spindle 37*b*, which coincides with pivotal center holes 36*b* of the shutter holder 36. The shutter member 37 pressed by the shutter biasing spring 39 is held in a state of being locked by a locking portion 36*i* (see FIGS. 2 and 3), which is provided in the shutter holder 36.

In this state, the abutment surface 37*a* of the shutter member 37 is at a protruding position where the abutment surface 37*a* protrudes further to the sheet conveyance path 26 side than a nip line of the pair of registration rollers 20. The sheet conveyance path 26 is configured to guide the sheet S conveyed from upstream of the pair of registration rollers 20 to the nip portion N1 of the pair of registration rollers 20 using a driven-roller-side guide 42 and a driving-roller-side guide 43, which are opposed to each other. The "nip line" refers to a line extending in the axial direction (i.e., from the front side to the rear side in FIG. 3) of the pair of registration rollers 20 from a center point, in the up-down direction in FIG. 3, of the nip portion N1. Further, the locking portion 36*i* is formed in a bent manner in the holding unit 36*h*, which protrudes from each part, in the longitudinal direction, of the spring abutment portion 36*f* of the shutter holder 36 (see FIG. 2).

When the abutment surface 37*a* is subjected to a force greater than that of the shutter biasing spring 39 from the sheet S, the shutter member 37 moves to the standby position (see FIG. 6B) where the shutter member 37 is retracted from the sheet conveyance path 26 to the shutter holder 36 side. As described above, the shutter member 37 is axially supported by the shutter holder 36 and configured to be pivotable to the protruding position, the retracted position, and the standby position. A single shutter biasing spring 39 is arranged for a single shutter member 37. Thus, in the present exemplary embodiment, six shutter biasing springs 39 are disposed in the longitudinal direction to correspond to the number of shutters.

In the present exemplary embodiment, a sheet detection unit (sheet detection device) 27 includes the sheet rear end detection portion 37*c* of the shutter member 37*s*, the sheet front end detection portion 36*c* of the shutter holder 36, and the photo-interrupter 40. The sheet detection unit 27, which mainly includes the shutter member 37*s* disposed at the position closer to the center than a sheet minimum size, can deal with sheets in all sizes conveyed from the sheet conveyance path 26.

Thus, the plurality of shutter members 37 including the shutter member 37*s* are configured to be pivotable (movable) integrally with the shutter holder 36 in a case where the front end (S1 in FIG. 5A) of the sheet S abuts on the abutment surfaces 37*a*. The plurality of shutter members 37 (total of six shutter members 37) are disposed in the longitudinal direction of the registration shutter unit 35 at the positions where the roller main bodies 31 and the driven rollers 33 of the pairs of registration rollers 20 do not form the nip portions N1, and also at the positions where the shutter members 37 do not coincide with end portions of a sheet in its width size. When subjected to a force greater than the force of the holder biasing spring 38 as a result of the front end S1 abutting on the abutment surfaces 37*a*, the shutter members 37 including the shutter member 37*s* pivot together with the shutter holder 36 in the counterclockwise direction (the direction indicated by the arrow B: see FIG. 5B). Then, each shutter member 37 pivots until the front end S1 goes past the protruding portion 37*g* and reaches the position where the front end S1 is separate from the abutment surface 37*a*. This position is referred to as a "separation position". The details will be described below.

As illustrated in FIG. 3, in the feeding frame (not illustrated) on the apparatus main body 1*a* side, the photo-interrupter 40 as a sheet presence/absence detection sensor is disposed at a position opposing the sheet front end detection portion 36*c* and the sheet rear end detection portion 37*c*. The photo-interrupter 40 detects whether a sheet passing through the nip portions N1 is present. The photo-interrupter 40 is connected to a control unit 44 provided in the apparatus main body 1*a* and including a central processing unit (CPU), a random-access memory (RAM), and a read-only memory (ROM). The control unit 44 has the function of a detection unit for detecting the presence or absence of a sheet based on a detection signal output from the photo-interrupter 40 by the sheet front end detection portion 36*c* and the sheet rear end detection portion 37*c* moving across the optical axis (optical path) 41 with the movements of the shutter holder 36 and the shutter members 37.

Figure 4:
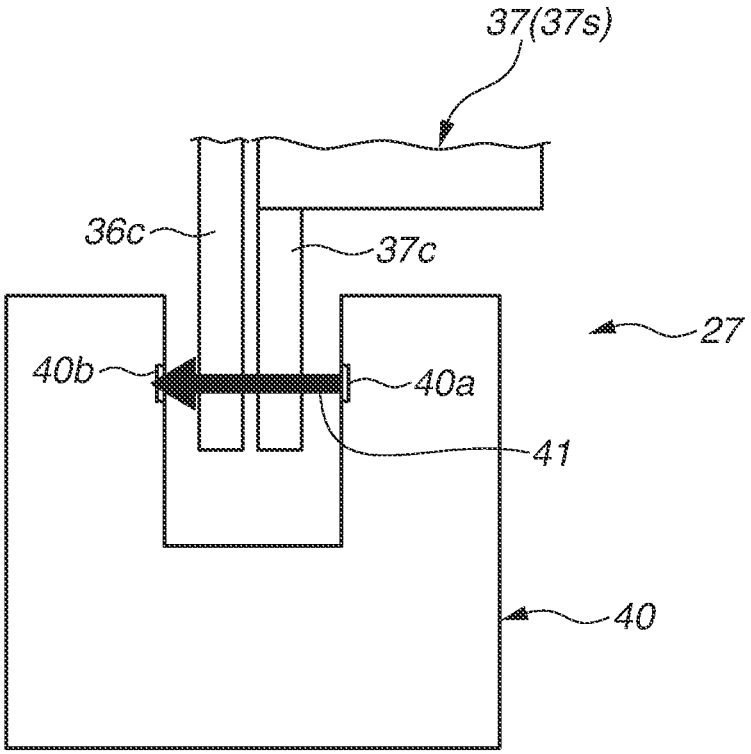
FIG. 4 is a cross-sectional view illustrating a positional relationship in a longitudinal direction between a photo-interrupter, a sheet front end detection portion, and a sheet rear end detection portion according to the first exemplary embodiment.

If the sheet front end detection portion 36*c* and the sheet rear end detection portion 37*c* perform the actions of advancing or retreating relative to the optical axis 41 (FIG. 4) between a light-emitting unit 40*a* and a light-receiving unit 40*b* of the photo-interrupter 40, and when the detection portions 36*c* and 37*c* interrupt the optical axis 41, an output signal from the light-receiving unit 40*b* is at a low level. On the other hand, when the detection portions 36*c* and 37*c* do not interrupt the optical axis 41, an output signal from the light-receiving unit 40*b* is at a high level. As described above, the photo-interrupter 40 outputs a signal to the control unit 44 according to the amount of light received by the light-receiving unit 40*b*. Based on this signal, the control unit 44 determines the presence or absence of a sheet according to a threshold for a signal set in advance. As illustrated in FIG. 4, the optical axis 41 is indicated by a straight line connecting the light-emitting unit 40*a* and the light-receiving unit 40*b*.

Next, with reference to FIG. 4, a description is given of the sheet front end detection portion 36*c* and the sheet rear end detection portion 37*c* for switching the optical axis 41 of the photo-interrupter 40 between the light-interrupted state and the light-transmitted state. FIG. 4 is a diagram illustrating an arrangement of the sheet front end detection portion 36*c* and the sheet rear end detection portion 37*c* relative to the photo-interrupter 40 in the longitudinal direction of the main body, and illustrating the state viewed in the direction indicated by an arrow J in FIG. 3.

As illustrated in FIG. 4, two members (i.e., the sheet front end detection portion 36*c* and the sheet rear end detection portion 37*c*) are disposed in the state of being arranged adjacent to each other in the direction of the optical axis 41 of the photo-interrupter 40. In the present exemplary embodiment, the sheet front end detection portion 36*c* and the sheet rear end detection portion 37*c* switch the same optical axis 41 between the light-interrupted state and the light-transmitted state, whereby the control unit 44 can determine the presence or absence of a sheet. As described above, the plurality of shutter members 37 are disposed at predetermined intervals in the axial direction of the pair of registration rollers 20, and a single photo-interrupter 40 is disposed to correspond to the shutter member 37*s*, which is located in the center portion in the axial direction, among the plurality of shutter members 37. In the present exemplary embodiment, the sheet front end detection portion 36*c* and the sheet rear end detection portion 37*c* each move relative to the optical axis 41 of the single photo-interrupter 40.

Further, when the optical axis 41 is in the light-transmitted state where the optical axis 41 is not interrupted by both the sheet rear end detection portion 37*c* and the sheet front end detection portion 36*c*, the control unit 44 determines that a sheet conveyed through the sheet conveyance path 26 is present. Further, when the optical axis 41 is in the light-interrupted state where the optical axis 41 is interrupted by the sheet front end detection portion 36*c* or the sheet rear end detection portion 37*c*, the control unit 44 determines that a sheet conveyed through the sheet conveyance path 26 is not present. Thus, the sheet rear end detection portion 37*c* and the sheet front end detection portion 36*c* perform the actions of advancing or retreating relative to the optical axis 41, whereby the control unit 44 can determine the presence or absence of a sheet conveyed through the sheet conveyance path 26 with high accuracy.

Further, when the photo-interrupter 40 is switched from the light-transmitted state to the light-interrupted state by the movement of the sheet front end detection portion 36*c*, the control unit 44 determines that the front end of a sheet conveyed from the sheet conveyance path 26 has arrived. On the other hand, when the photo-interrupter 40 is switched from the light-interrupted state to the light-transmitted state by the movement of the sheet rear end detection portion 37*c*, the control unit 44 determines that the rear end of a sheet conveyed from the sheet conveyance path 26 has arrived. In this way, the control unit 44 can determine the arrival of the front end of a sheet and the arrival of the rear end of a sheet with high accuracy. Further, based on a detection signal from the photo-interrupter 40, the control unit 44 controls the image forming unit 70 to start an image forming operation for forming an image on a sheet. Consequently, it is possible to form an image with high accuracy.

<Action of Registration Shutter Unit and Sheet Detection According to Action>

Next, with reference to FIGS. 5A to 5C and FIGS. 6A to 6C, a description is given of an action of the registration shutter unit 35 and the detection of the sheet S according to the action of the registration shutter unit 35, according to the present exemplary embodiment.

Figure 5A:
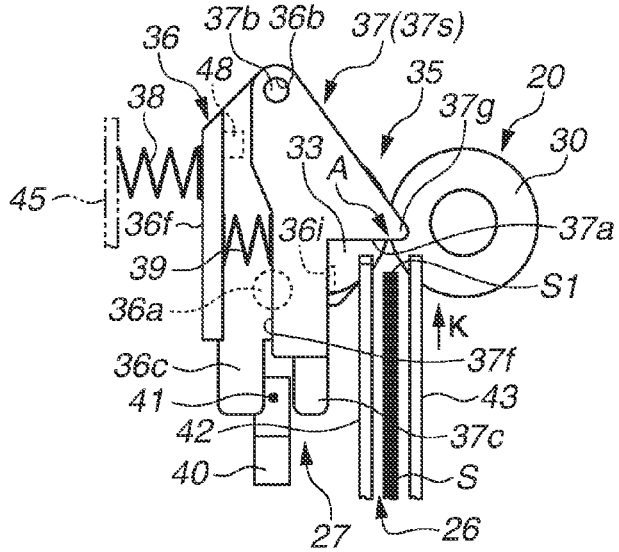
FIG. 5A is a cross-sectional view illustrating a state immediately before a sheet abuts on an abutment surface.
Figure 5B:
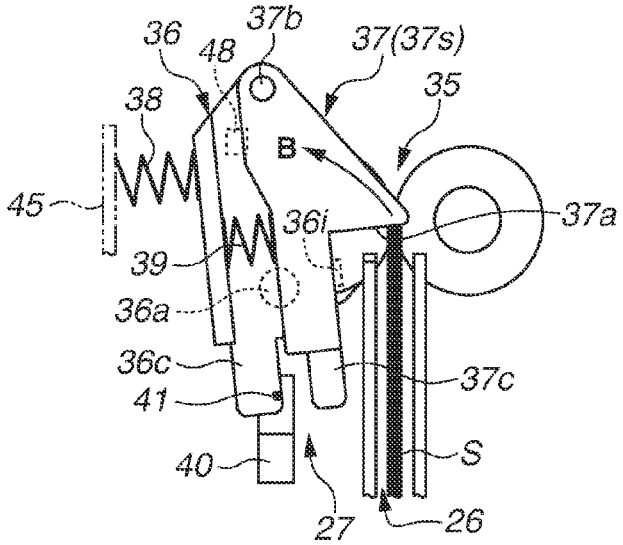
FIG. 5B is a cross-sectional view illustrating a state where a front end of the sheet abuts on the abutment surface, a shutter holder pivots together with a shutter member, and the sheet front end detection portion starts interrupting light across an optical axis.
Figure 5C:
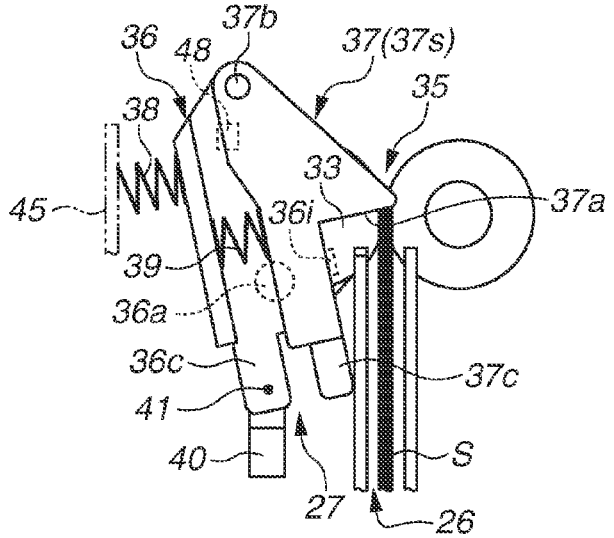
FIG. 5C is a cross-sectional view illustrating a state where the abutment surface is pushed further by the front end of the sheet, and the shutter holder and the shutter member pivot further.
Figure 6A:
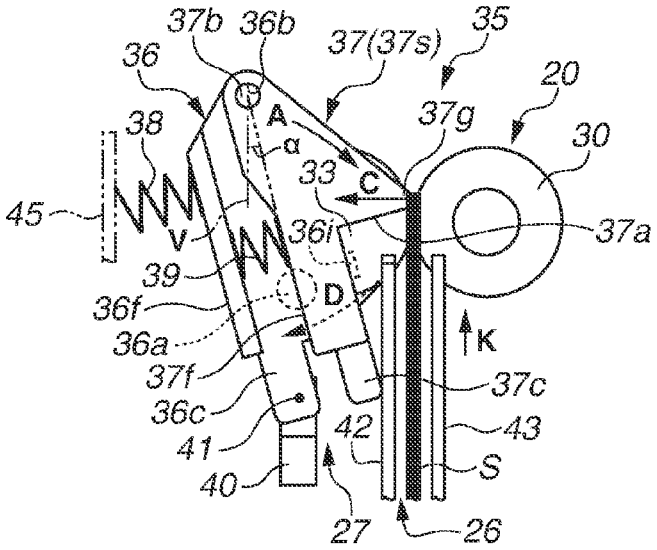
FIG. 6A is a cross-sectional view illustrating a state where, after the shutter holder reaches a separation position, the sheet is conveyed further, and the front end of the sheet goes past the abutment surface.
Figure 6B:
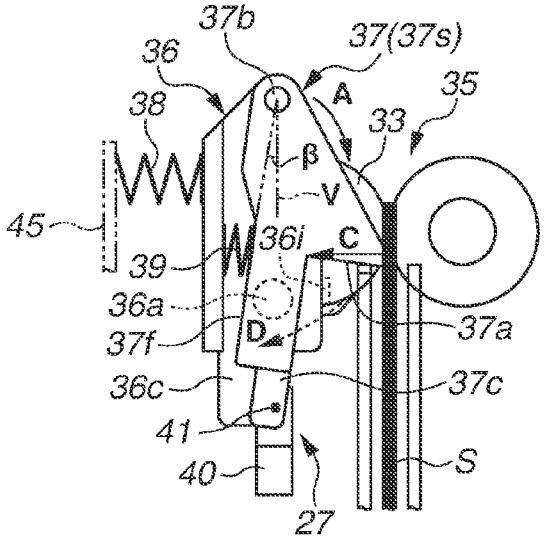
FIG. 6B is a cross-sectional view illustrating a state where the shutter holder returns to a close position, and the shutter member is at a standby position.
Figure 6C:
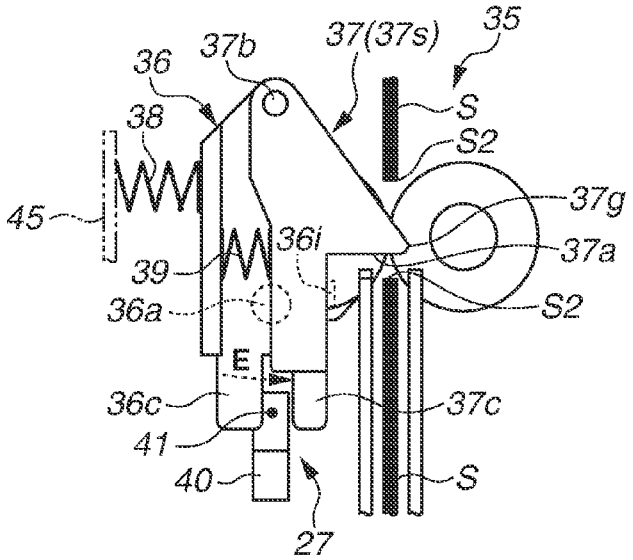
FIG. 6C is a cross-sectional view illustrating a state where a rear end of the sheet goes out of a nip portion, and the shutter member is at a protruding position.

FIG. 5A is a cross-sectional view illustrating a state immediately before a sheet abuts on the abutment surface 37*a* (protruding position and close position). FIG. 5B is a cross-sectional view illustrating a state where the front end of the sheet abuts on the abutment surface 37*a*, the shutter holder 36 pivots together with the shutter member 37, and the sheet front end detection portion 36*c* starts interrupting the light along the optical axis 41. FIG. 5C is a cross-sectional view illustrating a state where the abutment surface 37*a* is pushed further by the front end of the sheet, and the shutter holder 36 and the shutter member 37 pivot further (retracted position and separation position). Further, FIG. 6A is a cross-sectional view illustrating a state where, after the shutter holder 36 reaches the separation position, the sheet is conveyed further, and the front end of the sheet goes past the abutment surface 37*a*. FIG. 6B is a cross-sectional view illustrating a state where the shutter holder 36 returns to the close position, and the shutter member 37 is at the standby position. FIG. 6C is a cross-sectional view illustrating a state where the rear end of the preceding sheet comes out of a nip portion N1 (see FIG. 3) of the pair of registration rollers 20, and the shutter member 37 is at the protruding position.

As illustrated in FIG. 5A, the shutter holder 36 stands by at the close position, and the shutter member 37 stands by at the protruding position. In this state, the sheet S guided through the sheet conveyance path 26 located upstream of the pair of registration rollers 20 hits the abutment surface 37*a* before being nipped by a nip portion N1 of the pair of registration rollers 20. At this time, in the sheet detection unit 27, the optical axis 41 of the photo-interrupter 40, the sheet front end detection portion 36*c*, and the sheet rear end detection portion 37*c* are at positions where the sheet front end detection portion 36*c* and the sheet rear end detection portion 37*c* do not interfere with the optical axis 41 of the photo-interrupter 40, i.e., are in the light-transmitted state.

Then, the plurality of shutter members 37 including the shutter member 37*s* corrects the skew of the sheet S by the respective abutment surfaces 37*a*. The skew correction method by the abutment surfaces 37*a* is similar to a known registration shutter method and therefore is briefly described. The sheet S abutting on the abutment surfaces 37*a* is locked by the force of the holder biasing spring 38 in the pivotal direction (FIG. 5A: the force in the direction indicated by an arrow A). If the sheet S enters the shutter members 37 while skewing on the sheet conveyance path 26 serving as a conveyance portion on the upstream side, the front end S1 of the sheet S abuts on the abutment surface 37*a* on an end portion in the longitudinal direction first. Then, the front end S1 abuts on and is locked by all the shutter portions in the longitudinal direction, thereby correcting the skew of the front end of the sheet. The sheet S in the state of being locked by the abutment surfaces 37*a* is pushed by the pair of feeding pull-out rollers 16 (see FIG. 1) serving as a sheet conveyance unit on the upstream side, thereby forming a loop. If the sheet S forms a predetermined amount of loop, and a force against the force of the holder biasing spring 38 acts on the abutment surfaces 37*a*, the shutter holder 36 is caused to pivot in the direction indicated by the arrow B (see FIG. 5B).

As illustrated in FIG. 5B, if the front end S1 of the sheet S presses the abutment surface 37*a*, and the shutter holder 36 pivots about a pivotal spindle 37*b* in the direction indicated by the arrow B, the sheet front end detection portion 36*c* interrupts the light across the optical axis 41. At this timing, the control unit 44 starts the driving of the driving motor 28 (see FIG. 3). Thus, the sheet S is nipped at the nip portion N1 of the pair of registration rollers 20. In this case, when the abutment surface 37*a* is pressed by the front end S1 of the conveyed sheet S, and the shutter member 37 moves from the protruding position to the retracted position, the shutter holder 36 moves together with the shutter member 37 toward the separation position. Then, the photo-interrupter 40 is switched to the light-interrupted state by the sheet front end detection portion 36*c*. Thus, immediately after the abutment surface 37*a* is pressed by the front end S1 of the conveyed sheet S, the control unit 44 can determine that the sheet S is present.

If the light along the optical axis 41 is interrupted by the sheet front end detection portion 36*c*, the control unit 44 (see FIG. 3) determines that the sheet S reaches the nip portion N1 of the pair of registration rollers 20. In the present exemplary embodiment, if determining that the sheet S reaches the nip portion N1, the control unit 44 calculates the distance difference between the image recording position and the toner image already transferred onto the intermediate transfer belt 8 (FIG. 1). Then, the control unit 44 accelerates or decelerates the driving motor 28 (see FIG. 3), thereby performing control to reduce an error in the image recording position on the sheet S. As described above, based on a detection signal from the photo-interrupter 40, the control unit 44 controls the driving motor 28 to accelerate or decelerate the sheet conveyance speed in synchronized timing with an image formed by the image forming unit 70. Thus, it is possible to form an image with high accuracy.

If the shutter holder 36 pivots further in the same direction from the position illustrated in FIG. 5B, and the abutment surface 37*a* gradually retracts in a direction away from the sheet conveyance path 26, and the shutter holder 36 pivots to the separation position illustrated in FIG. 5C, the abutment surface 37*a* finally has a positional relationship in which the abutment surface 37*a* does not abut on the front end S1. If the shutter holder 36 is at the separation position, the sheet detection unit 27 is in a state where the sheet front end detection portion 36*c* interrupts the light across the optical axis 41. At this time, the sheet rear end detection portion 37*c* is at the position of transmitting the light along the optical axis 41.

As in FIG. 6A, if the shutter holder 36 reaches the separation position, and the sheet S is conveyed further, the front end S1 goes past the protruding portion 37*g* of the abutment surface 37*a* and has a positional relationship in which the front end S1 does not abut on the abutment surface 37*a*. Then, each of the plurality of shutter members 37 including the shutter member 37*s* is subjected to a reaction force in the direction indicated by the arrow C via the protruding portion 37*g* from the sheet S of which the front end S1 has gone past the protruding portion 37*g* and advances further in the sheet conveyance direction (the direction indicated by the arrow K). At this time, the shutter member 37 subjected to the reaction force in the direction indicated by the arrow C is going to pivot about the pivotal spindle 37*b* in the direction indicated by a dashed arrow D (see FIG. 6B). If this reaction force becomes greater than the biasing force of the shutter biasing spring 39, the shutter member 37 starts pivoting in the direction indicated by the arrow D. The shutter biasing spring 39 is set to bias the shutter member 37 with a force weaker than the moment of the reaction force of the sheet S, and the positional relationship of the pivotal spindle 37*b* is set so that if subjected to the reaction force of the sheet S, the shutter member 37 pivots in the direction indicated by the arrow D.

In FIG. 6B, the pressing force from the front end S1 via the shutter member 37 disappears, and therefore, according to the biasing force of the holder biasing spring 38, the shutter holder 36 is caused to pivot about pivotal shafts 36*a* in the direction indicated by the arrow A. As described above, in the sheet detection unit 27, the sheet front end detection portion 36*c* pivots from the position of interrupting the light across the optical axis 41 to the position of transmitting the light along the optical axis 41, while simultaneously, the sheet rear end detection portion 37*c* pivots from the position of transmitting the light along the optical axis 41 to the position of interrupting the light across the optical axis 41.

As described above, according to the biasing force of the holder biasing spring 38, the shutter holder 36 pivots from the separation position in FIG. 6A in the direction indicated by the arrow A and returns to the close position, the shutter member 37 pivots in the direction indicated by the dashed arrow D while being in contact with the surface of the sheet S. Also when the shutter holder 36 pivots further and returns to the close position illustrated in FIG. 6B, the pivotal action of the shutter member 37 to the protruding position is restricted by the reaction force of the sheet S, and the shutter member 37 is in a state of standing by to protrude at the standby position. At this time, in the sheet detection unit 27, the sheet front end detection portion 36*c* is at the position of transmitting the light along the optical axis 41, while the sheet rear end detection portion 37*c* is at the position of interrupting the light across the optical axis 41.

Then, if the sheet S is conveyed by the pair of registration rollers 20, the rear end of the sheet S passes through the protruding portion 37*g* of the shutter member 37, and the reaction force of the sheet S against the shutter member 37 disappears. Thus, by the biasing force of the shutter biasing spring 39, the shutter member 37 pivots to the protruding position illustrated in FIG. 6C in the counterclockwise direction in FIG. 6C. By this pivoting, the shutter member 37 moves relative to the shutter holder 36 having returned to the close position, thereby instantaneously returning to the protruding position. Then, the action of the shutter member 37 when a single sheet S passes is completed, and the shutter member 37 is in the state of standing by for a front end S2 of a next sheet S.

At this time, in the sheet detection unit 27, the sheet front end detection portion 36*c* is at the position of transmitting the light along the optical axis 41. When the shutter member 37 is at the standby position (FIG. 6B), the sheet rear end detection portion 37*c* is at the position of interrupting the light across the optical axis 41. At this time, when the rear end of the sheet passes through the shutter member 37, and the shutter member 37 pivots in the direction indicated by a dashed arrow E and returns to the protruding position, the state where the sheet rear end detection portion 37*c* interrupts the light across the optical axis 41 is instantaneously switched to the state where the sheet rear end detection portion 37*c* transmits the light along the optical axis 41. The position of the sheet rear end detection portion 37*c* is set to almost match the timing when these states are switched and the timing when the rear end of the sheet passes through the nip portion N1 of the pair of registration rollers 20.

The sheet conveyance device 71 according to the first exemplary embodiment includes the shutter holder 36 supported to be movable to the close position where the shutter holder 36 is close to the sheet conveyance path 26, and to the separation position where the shutter holder 36 is separate from the sheet conveyance path 26, and the shutter members (sheet abutment members) 37. Each shutter member 37 is held by the shutter holder 36 to be relatively movable thereto and supported to be movable to the protruding position, the retracted position, and the standby position. In the sheet conveyance device 71, the shutter holder 36 is supported to be pivotable around the pivotal shaft 36*a* using serving as a support point disposed outside the sheet conveyance path 26. Further, each shutter member 37 is supported by the shutter holder 36 to be pivotable around the pivotal spindle 37*b* serving as a support point, which is disposed downstream in the sheet conveyance direction, of the pivotal shafts 36*a* disposed outside the sheet conveyance path 26.

Then, the sheet conveyance device 71 includes the holder biasing spring (first biasing member) 38 for biasing the shutter holder 36 holding the shutter members 37 from the separation position toward the close position. Further, the sheet conveyance device 71 includes the shutter biasing spring (second biasing member) 39 for biasing the shutter member 37 held by the shutter holder 36 to be relatively movable from the standby position toward the protruding position. The shutter biasing spring has a biasing force weaker than that of the holder biasing spring 38. Then, the shutter biasing spring 39 is provided upstream of the holder biasing spring 38 in the sheet conveyance direction. Therefore, the action of each shutter member 37 shifting from the separation position (FIG. 6A) to the standby position (FIG. 6B) is smoother.

<Method for Detecting Sheet>

Figure 7:
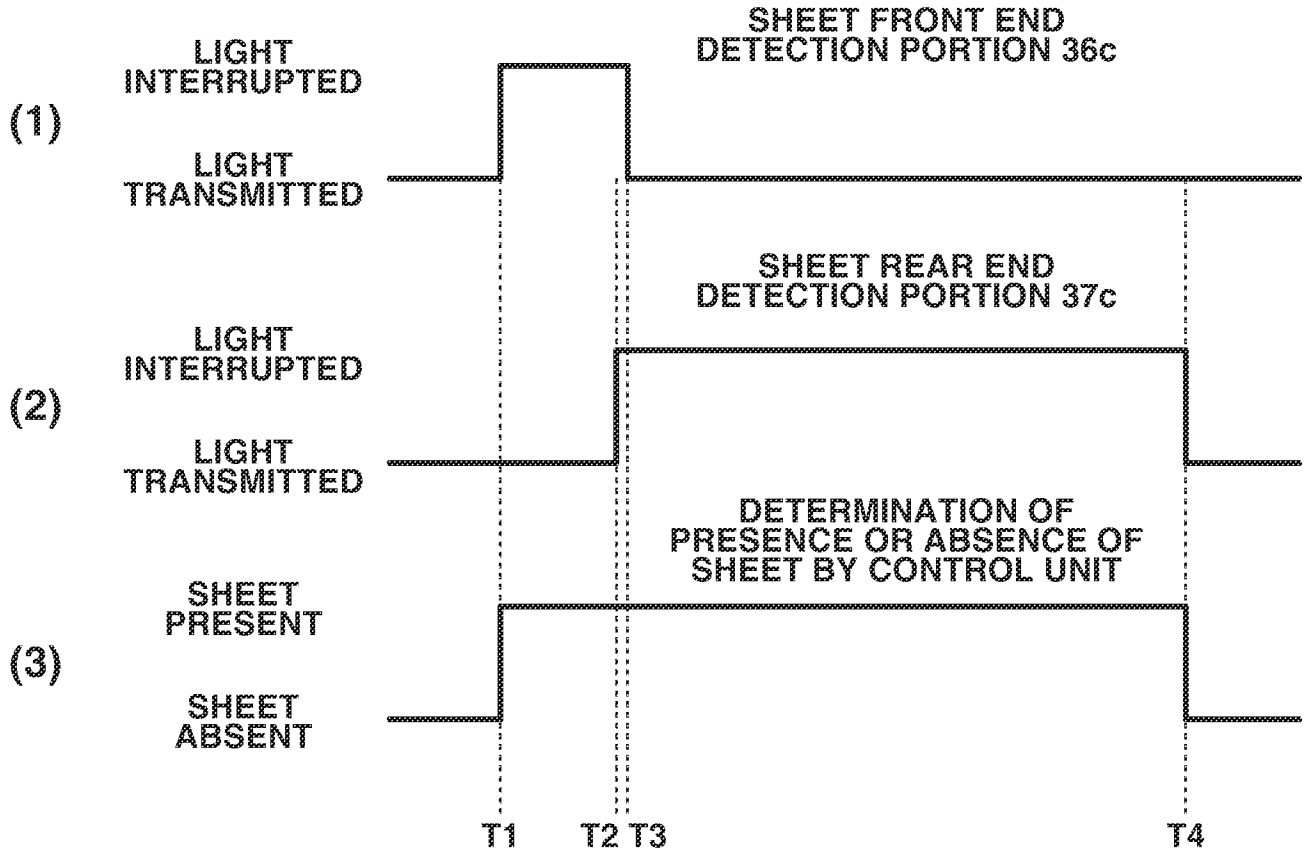
FIG. 7 is a timing chart illustrating a state of the photo-interrupter and determination of presence or absence of a sheet by a control unit according to the first exemplary embodiment.

Next, with reference to FIG. 7, a description is given of a method for detecting the sheet S in the present exemplary embodiment. FIG. 7 is a timing chart illustrating the switching between the light-interrupted state and the light-transmitted state of the photo-interrupter 40 by the sheet front end detection portion 36*c* and the sheet rear end detection portion 37*c*, and the determination of the presence or absence of a sheet by the control unit 44 according to an output from the photo-interrupter 40. In FIG. 7, a horizontal axis represents time, and a vertical axis represents (1) a detection signal based on the sheet front end detection portion 36*c*, (2) a detection signal based on the sheet rear end detection portion 37*c*, and (3) the determination of the presence or absence of a sheet by the control unit 44.

In FIG. 7, on the horizontal axis, a time T1 indicates a time when the optical axis 41 of the photo-interrupter 40 is switched from the light-transmitted state to the light-interrupted state by the sheet front end detection portion 36*c*. A time T2 indicates a time when the optical axis 41 is switched from the light-transmitted state to the light-interrupted state by the sheet rear end detection portion 37*c*. A time T3 indicates a time when the optical axis 41 is switched from the light-interrupted state to the light-transmitted state by the sheet front end detection portion 36*c*. A time T4 indicates a time when the optical axis 41 is switched from the light-interrupted state to the light-transmitted state by the sheet rear end detection portion 37*c*.

At a time period before the time T1, both the sheet front end detection portion 36*c* and the sheet rear end detection portion 37*c* are at the positions of transmitting the light along the optical axis 41 (FIG. 5A). Therefore, receiving a signal indicating the light-transmitted state from the photo-interrupter 40, the control unit 44 determines that the sheet S entering the nip portions N1 is not present. At the time T1, the sheet front end detection portion 36*c* moves from the position of transmitting the light along the optical axis 41 to the position of interrupting the light across the optical axis 41 (FIGS. 5B, 5C, and 6A). On the other hand, the sheet rear end detection portion 37*c* changes its position to the side on which the sheet rear end detection portion 37*c* is separate from the optical axis 41. Thus, the sheet rear end detection portion 37*c* does not interrupt the light along the optical axis 41 (FIGS. 5B, 5C, and 6A). Thus, the optical axis 41 is switched to the state where the light transmitting along the optical axis 41 is interrupted by the sheet front end detection portion 36*c*. Therefore, at the time T1, the control unit 44 determines that the sheet S is present. Then, the control unit 44 determines that the front end of the sheet S reaches the pair of registration rollers 20.

Then, the sheet S is conveyed in the sheet conveyance direction (direction indicated by the arrow K). At the time T2, the sheet rear end detection portion 37*c* interrupts the light across the optical axis 41 (FIG. 6A to FIG. 6B). At the time of the interrupting of the light, at the time T2, the sheet rear end detection portion 37*c* interrupts the light across the optical axis 41 which has already been interrupted by the sheet front end detection portion 36*c* since the time T1. Then, at the time T3, the sheet front end detection portion 36*c* moves out from the optical axis 41. At the time T3, the sheet front end detection portion 36*c* moves from the position of interrupting the light across the optical axis 41 to the position of transmitting the light along the optical axis 41 (FIG. 6B). At this time, the optical axis 41 is in the state where the light along the optical axis 41 has been already interrupted by the sheet rear end detection portion 37*c*. Thus, at the times T1, T2, and T3, the control unit 44 continuously recognizes that the optical axis 41 is in the light-interrupted state, and determines that the sheet S is present in the nip portions N1 of the pair of registration rollers 20.

Then, at the time T4, the sheet rear end detection portion 37*c* moves from the position of interrupting the light across the optical axis 41 to the position of transmitting the light along the optical axis 41 (FIG. 6C). On the other hand, the sheet front end detection portion 36*c* does not move from the position of transmitting the light along the optical axis 41 (FIG. 6C). Thus, the optical axis 41 is in the light-transmitted state where the light transmitted along the optical axis 41 is interrupted by neither of the two detection portions 36*c* and 37*c*. Thus, at the time T4, the control unit 44 determines that the rear end of the sheet S passing through the nip portions N1 has passed through the nip portions N1 of the pair of registration rollers 20.

As can be understood from the timing chart in FIG. 7, in the present exemplary embodiment, the sheet front end detection portion 36*c* detects the front end of the sheet S, and the sheet rear end detection portion 37*c* detects the rear end of the sheet S. As described above, based on the combinations in which the sheet front end detection portion 36*c* and the sheet rear end detection portion 37*c* switch the optical axis 41 of the single photo-interrupter 40 between the state where the light transmitting along the optical axis 41 is interrupted and the state where the light along the optical axis 41 is transmitted, it is possible to detect the sheet S.

In the present exemplary embodiment, if the shutter holder 36 is caused to pivot to the separation position by the pressing force of the front end S1 of the sheet S, and the sheet S is conveyed to the position where the front end S1 is separate from the protruding portion 37*g*, the shutter holder 36 returns to the close position (FIG. 6B). In the present exemplary embodiment, in each shutter member 37, a pivotal range a (FIG. 6A) around the pivotal spindle 37*b* serving as a support point, which is pivotable from a straight line V extending in the vertical direction to the sheet conveyance path 26 side, is set to 15 degrees, for example. The pivotal range a is the angle between the straight line V and the spring abutment portion 37*f* of the shutter member 37.

Accordingly, when the shutter holder 36 returns to the close position, a return time corresponding to 15 degrees is required. The shutter holder 36 holds the plurality of shutter members 37 in the longitudinal direction of the main body and therefore is heavier in weight than the shutter members 37. Thus, the shutter holder 36 has a large moment of inertia. As a result, due to the influence of the moment of inertia when the shutter holder 36 returns to the close position, the shutter holder 36 may bounce (vibrate) when abutting on the feeding frame abutment portion 48 (see FIG. 5A).

As in a comparative example described below, if the configuration is such that after the rear end of the sheet S comes out of the nip portions N1, the shutter holder 36 returns to a standby state, it is difficult to cause the following sheet to enter a shutter locking portion until the bounce subsides. In contrast, in the present exemplary embodiment, the shutter holder 36 returns to the close position at the time when the front end of the sheet comes out of the protruding portion 37*g*. Accordingly, before the rear end of the preceding sheet has passed through the nip portion N1, the action of returning by 15 degrees and the bouncing action occurring in a configuration having a large moment of inertia has ended. Thus, the preparation for standing by for the following sheet is completed at this time. Consequently, it is possible to effectively shorten the sheet-to-sheet distance.

On the other hand, the shutter member 37 is a component having a small moment of inertia. Thus, even when the shutter member 37 returns from the standby position to the protruding position at the time when the rear end of the sheet comes out of the protruding portion 37*g* of the shutter member 37, a vibration hardly occurs. Further, in the present exemplary embodiment, a pivotal range 3 (FIG. 6B) of the shutter member 37 around the pivotal spindle 37*b* serving as a support point, which is pivotable from the straight line V to the spring abutment portion 36*f* side, is set to 5 degrees, for example. Thus, the amount of pivoting of the shutter member 37 at the standby position can be smaller than the amount of pivoting of the shutter holder 36. This shortens the time taken by the shutter member 37 to return to the protruding position as compared with a conventional configuration. Therefore, when returning to the protruding position, the shutter member 37 immediately enters the state of standing by for the following sheet.

Comparative Example

Figure 16:
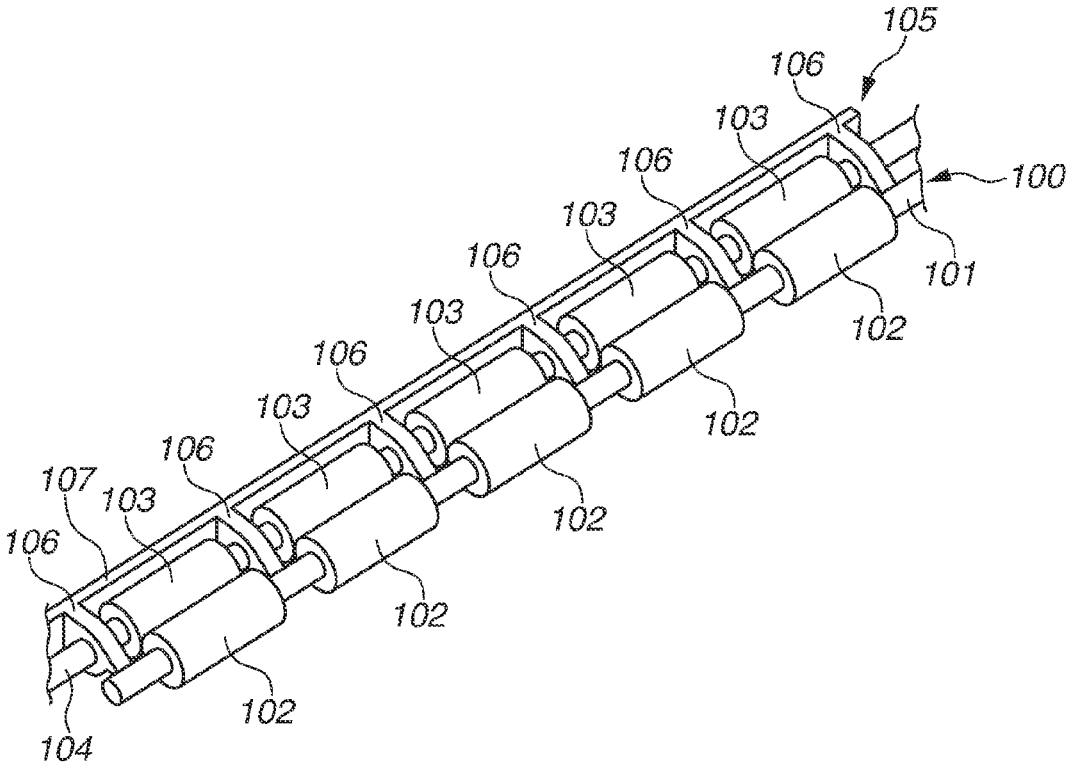
FIG. 16 is a perspective view illustrating a registration shutter unit according to a comparative example.
Figure 17A:
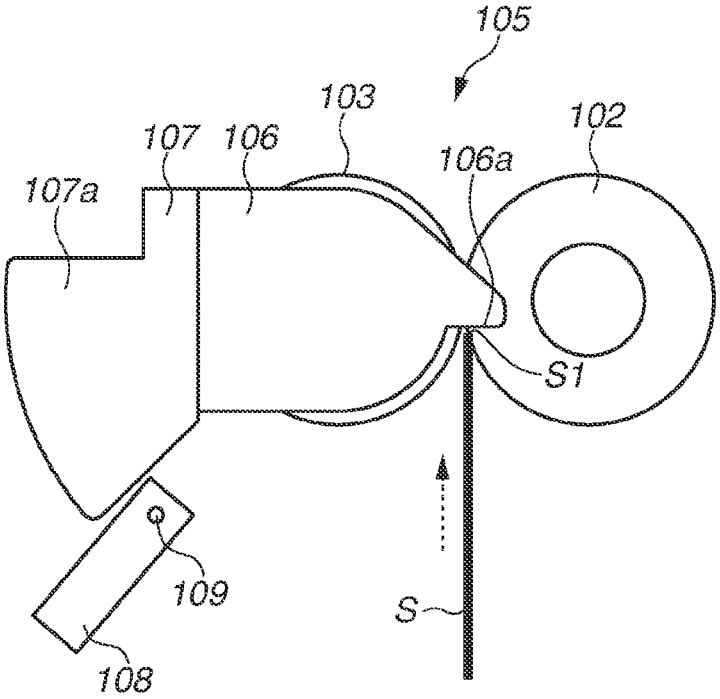
FIG. 17A is a cross-sectional view illustrating a state immediately before a sheet abuts on a shutter member.
Figure 17B:
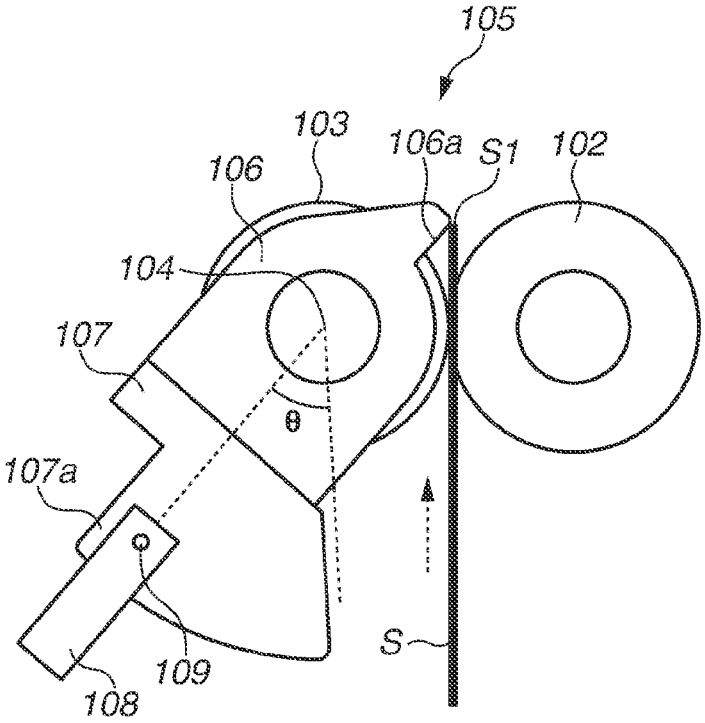
FIG. 17B is a cross-sectional view illustrating a state where the shutter member abuts on the conveyed sheet and pivots according to the comparative example.

With reference to FIGS. 16, 17A, and 17B, a comparative example for the present exemplary embodiment is described. FIG. 16 is a perspective view illustrating a registration shutter unit 105 in the comparative example. FIG. 17A is a cross-sectional view illustrating a state immediately before a sheet abuts on a shutter member 106 in the comparative example. FIG. 17B is a cross-sectional view illustrating the shutter member 106 pivoting while abutting on the conveyed sheet.

A registration shutter unit 105 includes a pair of conveyance rollers 100. The pair of conveyance rollers 100 includes a roller shaft 101 and roller main bodies 102 opposing each other. Driven rollers 103 opposing the roller main bodies 102 are supported by a roller shaft 104. The driven rollers 103 are pressed to the roller main bodies 102 by springs (not illustrated) provided at both end portions, thereby forming nip portions. As the nip portions between the roller main bodies 102 and the driven rollers 103, five nip portions are disposed in the longitudinal direction of the main body. The registration shutter unit 105 includes the shutter members 106, which pivot about the roller shaft 104 in a state of being held by a shutter holder 107. Each shutter member 106 includes a sheet locking surface 106*a*, which abuts on the front end of a conveyed sheet S.

In an end portion of the shutter holder 107, a sensor flag 107*a* is provided. The sensor flag 107*a* acts to switch an optical axis 109 of a photo-interrupter 108, which is disposed on the apparatus main body side, between a light-transmitted state and a light-interrupted state according to two states, i.e., the state where the shutter member 106 stands by for a sheet and the state where the sheet passes through the sheet locking surface 106*a*. With the shutter member 106, a registration shutter spring (not illustrated) is provided as a biasing member and applies a biasing force to the shutter member 106 so that the shutter member 106 is located at a standby position. To reduce variation in detection of the position of the front end of the sheet S, the position where the sensor flag 107*a* interrupts the light across the optical axis 109 corresponds to the position where the sheet S is near the nip portion.

In FIG. 17A, the sensor flag 107*a* is at the position of transmitting the light along the optical axis 109 of the photo-interrupter 108. When the sheet S is conveyed from upstream in a sheet conveyance direction indicated by a dashed arrow, a front end portion of the sheet S presses the sheet locking surface 106*a*. Thereby, a loop is formed in the sheet S. Then, when the force of the front end portion of the sheet pressing the shutter becomes greater than the spring pressure of the registration shutter spring, the shutter member 106 pivots about the roller shaft 104. In FIG. 17B, the sensor flag 107*a* is at the position of interrupting the light across the optical axis 109 of the photo-interrupter 108. If the rear end of the sheet S passes through the shutter member 106, the shutter member 106 returns to a standby state (FIG. 17A), and the sensor flag 107*a* also returns to the position of transmitting the light along the optical axis 109. As described above, the optical axis 109 of the photo-interrupter 108 is switched between the light-interrupted state and the light-transmitted state, thereby detecting the arrival of a sheet or detecting the length of a sheet.

Each shutter member 106 illustrated in FIG. 16 rotates about 50 degrees about the roller shaft 104 in a counter-clockwise direction during a time period between when the shutter member 106 stands by for a sheet and when the sheet passes through the shutter member 106. After the rear end of a preceding sheet S passes through the sheet locking surface 106*a* and until the shutter member 106 returns to the standby state, a return time corresponding to about 50 degrees is needed. For the length of this return time, it is not possible to allow a following sheet to enter the shutter member 106. Thus, in the configuration of this comparative example, the return time of the shutter member 106 hinders the reduction of the sheet-to-sheet distance. Further, with the reduction of the sheet-to-sheet distance, it is necessary to increase the detection accuracy of the front end and the rear end of the sheet S and provide feedback for image formation timing and the speed control of a conveying unit. After the rear end of the sheet S comes out of the sheet locking surface 106*a*, the optical axis 109 is in the state where the light transmitting along the optical axis 109 is interrupted for a time almost equal to the return time required until the shutter member 106 returns to the standby state. Thus, the rear end of the sheet S is detected as being longer than that in the actual length of the sheet S. Further, a case is considered where the shutter member 106 is heavy in weight and has a large moment of inertia. In this case, if the shutter member 106 is once pushed by the sheet S to pivot and then returns to the standby state again, and when the shutter member 106 abuts on a abutment portion (not illustrated), a vibration occurs. It is necessary to allow the front end of the following sheet to enter the shutter member 106 after this vibration subsides. This also hinders the reduction of the sheet-to-sheet distance.

The shutter holder 107 in this comparative example employs a method for detecting the rear end of a sheet using the sensor flag 107*a* (FIG. 17B), which is provided at an end portion of the shutter holder 107. Thus, an angle θ from the position where the shutter holder 107 is pushed by the front end S1 of the sheet S to pivot to the position where the optical axis 109 of the photo-interrupter 108 is in the light-transmitted state is large (FIG. 17B). Thus, it takes time to detect the rear end of the sheet after the rear end of the sheet comes out of the sheet locking surface 106*a*. In contrast, in the shutter member 37 according to the present exemplary embodiment, the pivotal ranges a and 3 (FIGS. 6A and 6B) are small. Thus, to detect the rear end of the sheet, the optical axis 41 is switched from the light-interrupted state to the light-transmitted state when the sheet rear end detection portion 37*c* returns from the standby position (FIG. 6B) to the protruding position (FIG. 6C). As a result, it is possible to detect the rear end of the sheet more accurately.

In the present exemplary embodiment, there is a case where the amount of pushing in of each shutter member 37 changes due to the difference between thin paper and thick paper. As in FIG. 6B, however, the positions of the pivotal spindle 37*b* of the shutter member 37 and the rotating shaft 33*a* of the driven roller 33 are shifted from each other. Therefore, the abutment surface 37*a* can continue to be in contact with the sheet S near the nip portion N1 of the pair of registration rollers 20. Thus, the difference in the amount of pushing in of the abutment surface 37*a* between thin paper and thick paper is small. Consequently, it is possible to detect the rear end of the sheet without being much influenced by the type of the sheet S. A front end portion of the sheet S can also be detected near the nip portion N1 of the pair of registration rollers 20. Thus, it is possible to accurately detect the front end and the rear end of the sheet. Consequently, it is possible to accurately detect the actual length of the sheet S, regardless of the type of the sheet.

Further, according to the present exemplary embodiment, the sheet front end detection portion 36*c* and the sheet rear end detection portion 37*c* switch the optical axis 41 of the single common photo-interrupter 40 between the light-interrupted state and the light-transmitted state, and the control unit 44 (FIG. 3) detects the sheet S based on the combinations resulting from this switching. Consequently, it is possible to detect a sheet while reducing costs and saving space. Further, in the present exemplary embodiment, it is possible to deal with even a case where the distance (sheet-to-sheet distance) between the rear end of a preceding sheet and a front end of a following sheet is shorter than the above comparative example. Thus, it is possible to achieve a sheet detection device for detecting the front end and the rear end of a sheet with high accuracy.

Modification Example 1

Figure 8:
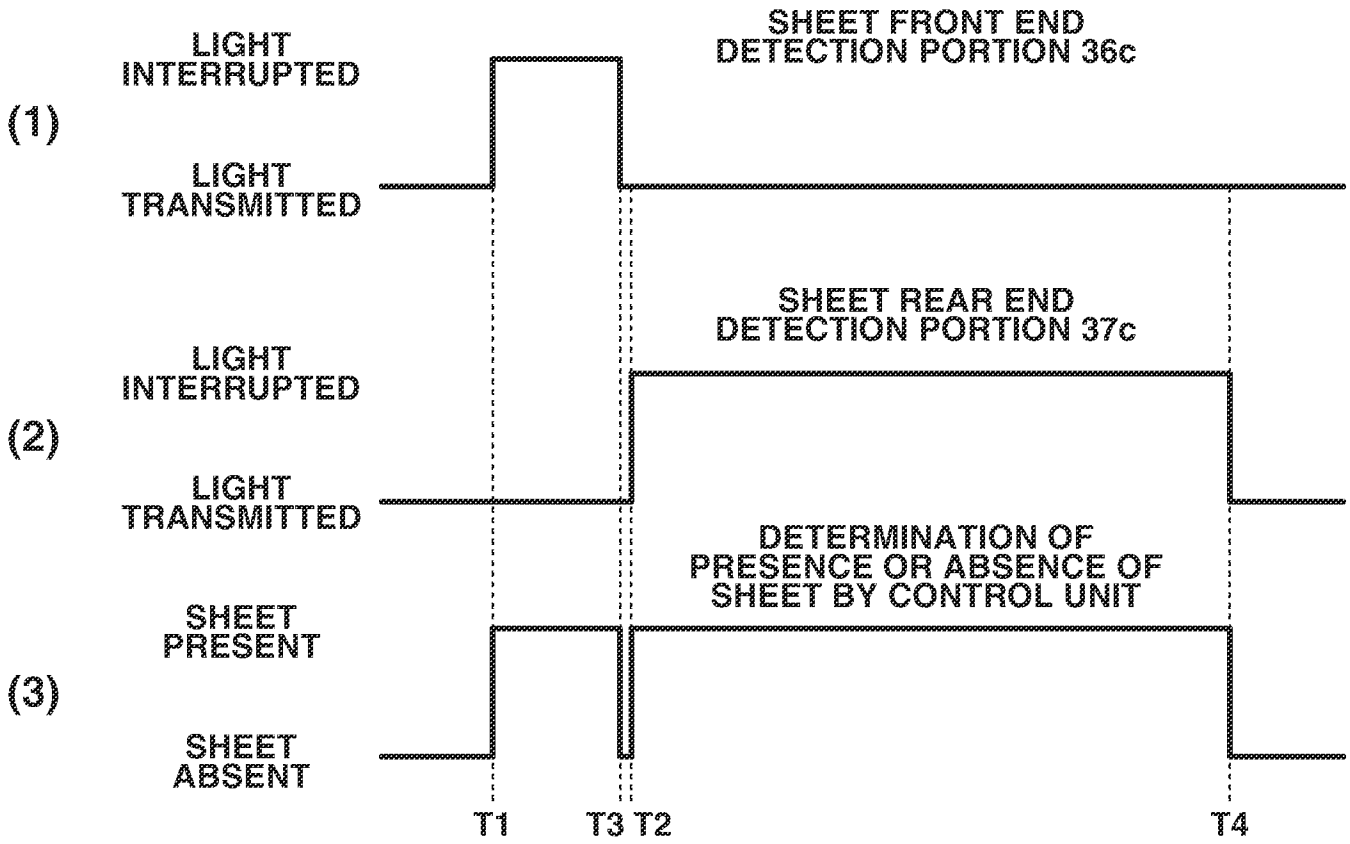
FIG. 8 is a timing chart illustrating a state of photo-interrupters and determination of presence or absence of a sheet by a control unit according to a modification example 1.
Figure 9:
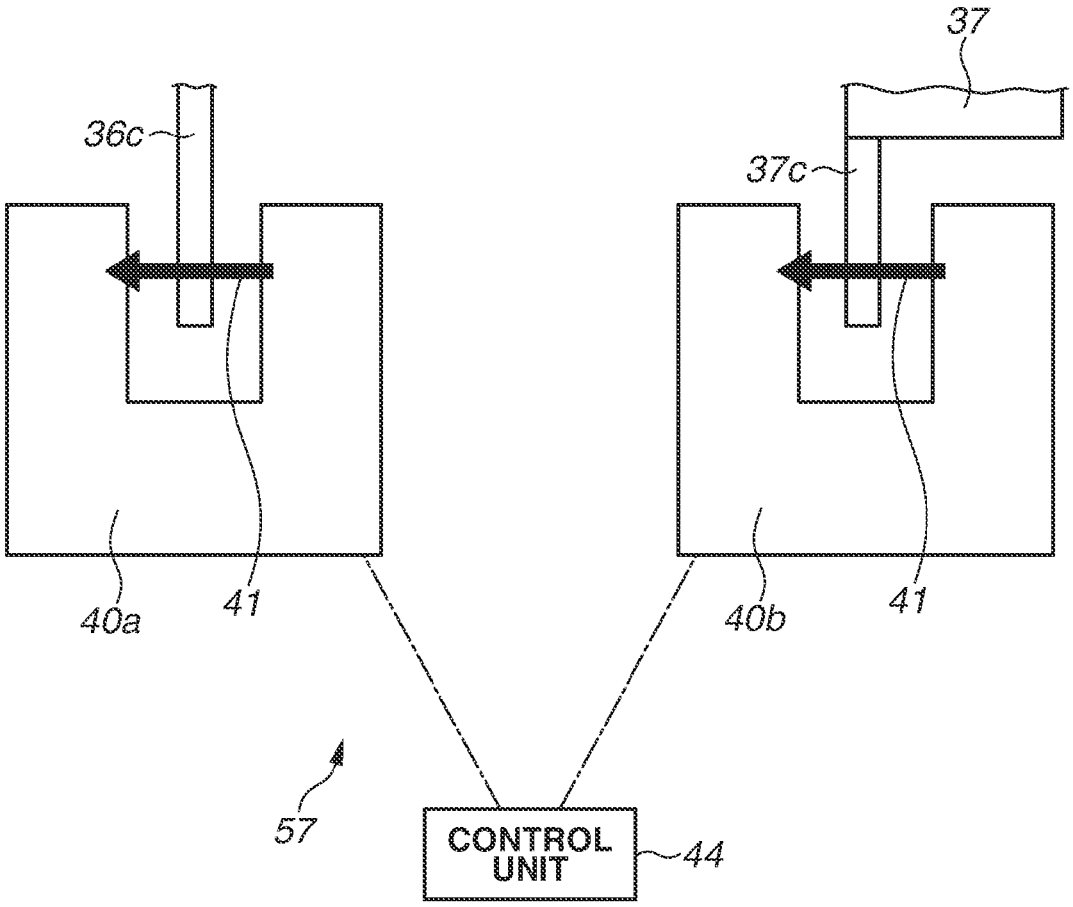
FIG. 9 is a cross-sectional view illustrating positional relationships in a longitudinal direction between the photo-interrupters, a sheet front end detection portion, and a sheet rear end detection portion according to the modification example 1.

Next, with reference to FIGS. 8 and 9, a modification example 1 of the first exemplary embodiment is described. FIG. 8 is a timing chart illustrating timing when a control unit 44 determines the presence or absence of a sheet based on detection signals when optical axes 41 are switched between light-interrupted states and light-transmitted states by a sheet front end detection portion 36*c* and a sheet rear end detection portion 37*c*. In the timing chart, a horizontal axis represents a time, and a vertical axis represents (1) a detection signal based on the sheet front end detection portion 36*c*, (2) a detection signal based on the sheet rear end detection portion 37*c*, and (3) a determination of the presence or absence of a sheet by the control unit 44. Further, FIG. 9 is a schematic diagram illustrating the configuration in which a photo-interrupter 40 (40*a* and 40*b*) is disposed for each of the sheet front end detection portion 36*c* and the sheet rear end detection portion 37*c*.

If variation in the position of the shutter holder 36 or the positions of the shutter members 37 is great in the longitudinal direction of the apparatus main body 1*a*, or the width in the longitudinal direction of the photo-interrupter 40 is small, there is a possibility that the sheet detection unit 27 and the photo-interrupter 40 interfere with each other in the longitudinal direction of the main body. In such a case, in the modification example 1, as illustrated in FIG. 9, a sheet detection unit (sheet detection device) 57 includes two photo-interrupters 40 (i.e., photo-interrupters 40*a* and 40*b*). Then, the control unit 44 is configured to determine the presence or absence of a sheet based on the combination of detection signals from the respective photo-interrupters 40*a* and 40*b*. With such a configuration, it is possible to provide a margin for variation in the position in the longitudinal direction of the apparatus main body 1*a*, thereby preventing an operation failure. The arrangement of a plurality of photo-interrupters enables the detection of a sheet in the width direction and therefore can eliminate the need to newly dispose a sheet detection unit in another portion. Thus, it is possible to reduce costs and save space.

The states at times T1 to T4 in FIG. 8 are almost similar to those at the times T1 to T4 described in FIG. 7. In this case, the relationship between the positions of the time T3 when the sheet front end detection portion 36*c* switches the optical axis 41 from a light-interrupted state to a light-transmitted state and the time T2 when the sheet rear end detection portion 37*c* switches the optical axis 41 from a light-transmitted state to a light-interrupted state is opposite to the relationship between the positions of the times T2 and T3 in FIG. 7. This opposite relationship can occur depending on the positional relationship between the sheet front end detection portion 36*c* and the sheet rear end detection portion 37*c*.

At the time T3, the sheet front end detection portion 36*c* moves from the position of interrupting the light across the optical axis 41 to the position of transmitting the light along the optical axis 41. On the other hand, the sheet rear end detection portion 37*c* is at the position of transmitting the light along the optical axis 41. Thus, the optical axes 41 are in the states where both the two detection portions 36*c* and 37*c* transmit the light along the optical axes 41 respectively, and the control unit 44 determines that the sheet S is not present. At the time T2, the sheet rear end detection portion 37*c* changes from the position of transmitting the light along the optical axis 41 to the position of interrupting the light across the optical axis 41. On the other hand, the sheet front end detection portion 36*c* remains at the position of transmitting the light along the optical axis 41. Thus, the optical axes 41 are in the states where the light along the corresponding optical axis 41 is interrupted by the sheet rear end detection portion 37*c*, and the control unit 44 determines that the sheet S is present.

Thus, in this state, at the time T3, the control unit 44 erroneously determines that the rear end of the sheet is detected. Then, at the time T2, the control unit 44 determines that the front end of the following sheet has arrived. Thus, in the modification example 1, the control unit 44 does not determine the presence or absence of a sheet in this time zone. That is, in the configuration in which the times T2 and T3 are reversed, such an erroneous determination can be made due to the arrangement relationship between the sheet front end detection portion 36*c* and the sheet rear end detection portion 37*c*. However, a time zone is provided during which the control unit 44 does not determine the presence or absence of a sheet, whereby it is possible to prevent the sheet S from being erroneously detected. Thereby, it is possible to increase the degree of freedom in arranging the sheet front end detection portion 36*c* and the sheet rear end detection portion 37*c*, while increasing the accuracy of the detection of the front end and the rear end of the sheet S.

Figure 10:
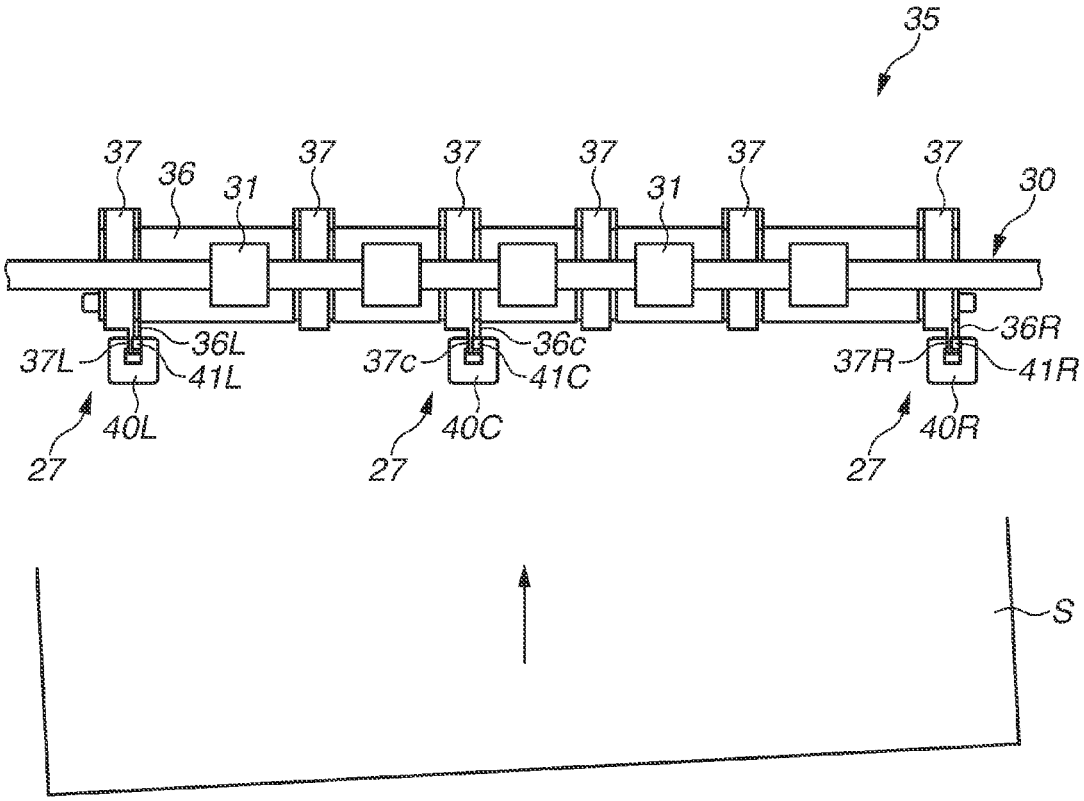
FIG. 10 is a diagram illustrating a relationship between arrangement of photo-interrupters and a sheet according to a second exemplary embodiment.
Figure 11:
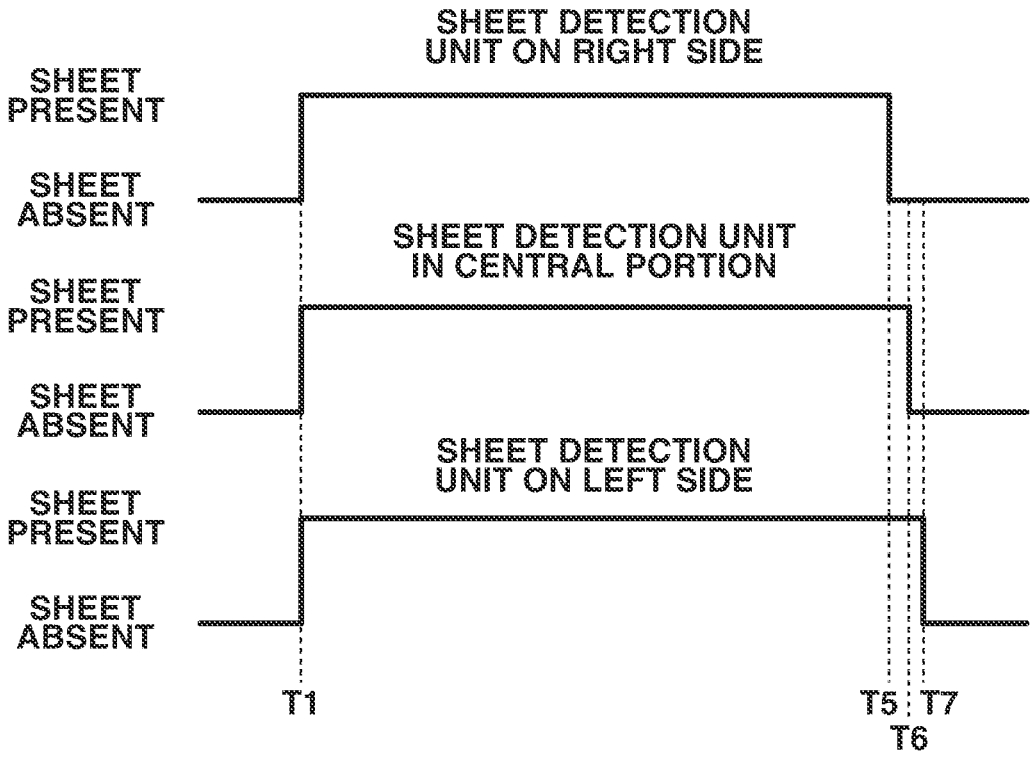
FIG. 11 is a timing chart illustrating states of the photo-interrupters and determination of presence or absence of a sheet by a control unit according to the second exemplary embodiment.

Next, with reference to FIGS. 10 and 11, a second exemplary embodiment is described. An image forming apparatus according to the present exemplary embodiment is similar to that according to the first exemplary embodiment. Thus, members similar to those in the first exemplary embodiment are designated by the same numerals, and members having configurations and functions similar to those in the first exemplary embodiment are not described here.

FIG. 10 is a diagram illustrating an example of a configuration in which a plurality of (three in the present exemplary embodiment) sheet detection units 27 in the first exemplary embodiment are disposed in the longitudinal direction of the main body, and illustrating a state where a sheet S of which the sheet rear end is skewed is conveyed. In the present exemplary embodiment, a sheet detection unit 27 including a sheet front end detection portion 36*c* and a sheet rear end detection portion 37*c* is disposed not only in a center portion as in the first exemplary embodiment, but also in both end portions.

In the present exemplary embodiment, a plurality of shutter members 37 are disposed at predetermined intervals in the axial direction of a pair of registration rollers 20, and a plurality of (three in the present exemplary embodiment) photo-interrupters are disposed to correspond to a plurality of (three in the present exemplary embodiment) shutter members among the shutter members 37. Sheet front end detection portions (first flag portions) 36*c*, 36L, and 36R and sheet rear end detection portions (second flag portions) 37*c*, 37L, and 37R move relative to optical axes (optical paths) 41C, 41L, and 41R of a plurality of corresponding photo-interrupters 40C, 40L, and 40R.

In the sheet detection units 27 disposed at both end portions of a registration shutter unit 35, the sheet front end detection portion 36L and the sheet rear end detection portion 37L are disposed on the left side of FIG. 10, and the sheet front end detection portion 36R and the sheet rear end detection portion 37R are disposed on the right side of FIG. 10. The photo-interrupter 40L on the left side, the photo-interrupter 40R on the right side, and the photo-interrupter 40C in the center are disposed in a feeding frame (not illustrated) on the apparatus main body 1*a* side to correspond to these detection units. The photo-interrupters 40L, 40C, and 40R have the optical axes 41L, 41C, and 41R, respectively.

FIG. 11 is a timing chart illustrating a determination of the presence or absence of a sheet by a control unit 44 based on the output waveforms of the photo-interrupters 40R and 40L at both end portions when the sheet S is skewed by the pair of registration rollers 20. A time T5 is a time when the optical axis 41R of the photo-interrupter 40R on the right side is switched from a light-interrupted state to a light-transmitted state, and the control unit 44 determines that the sheet S is not present. A time T6 is a time when the optical axis 41C in the center portion is switched from a light-interrupted state to a light-transmitted state, and the control unit 44 determines that the sheet S is not present. A time T7 is a time when the optical axis 41L on the left side is switched from a light-interrupted state to a light-transmitted state, and the control unit 44 determines that the sheet S is not present.

If the sheet S is conveyed to a shutter holder 36, an abutment surface 37*a* abuts on the front end of the sheet S, and the shutter holder 36 starts a pivotal action. Then, at a time T1, since the sheet front end detection portion 36*c* is formed in an integrated manner, the light along the optical axes 41L, 41C, and 41R of the photo-interrupters 40L, 40C, and 40R is interrupted at the same timing, regardless of the presence or absence of the skew of the front end of the sheet. Then, after the shutter holder 36 pivots to a separation position, and the sheet S passes through the abutment surface 37*a*, the shutter holder 36 is going to return to a close position. At this time, the shutter member 37 is subjected to the reaction force of the sheet S and starts a pivotal action to a standby position (see FIG. 6B), and the sheet rear end detection portions 37L, 37C, and 37R interrupt the light across the optical axes 41L, 41C, and 41R, respectively. Then, the sheet front end detection portions 36L, 36C, and 36R are at the positions of transmitting the light along the optical axes 41L, 41C, and 41R.

If the sheet S continues to be conveyed, the control unit 44 determines the presence or absence of the sheet S as in FIG. 11 because the rear end of the sheet is skewed as in FIG. 10. Thus, when the rear end of the sheet is conveyed and passes through the abutment surface 37*a* as in FIG. 10, then at the time T5, the shutter member 37 corresponding to the sheet rear end detection portion 37R on the right side starts pivoting from the standby position to a protruding position. Then, the optical axis 41R of the photo-interrupter 40R on the right side is switched from the light-interrupted state to the light-transmitted state. Therefore, the control unit 44 determines that the sheet S is not present. Then, at the time T6, the optical axis 41C corresponding to the photo-interrupter 40C in the center is switched to the light-transmitted state. Therefore, the control unit 44 determines that the sheet S is not present. Finally, at the time T7, the optical axis 41L corresponding to the photo-interrupter 40L on the left side is switched to the light-transmitted state. Therefore, the control unit 44 determines that the sheet S is not present.

In the present exemplary embodiment, the above arrangement configuration is provided, whereby the difference in synchronized timing of the passing of the rear end of the sheet S in the longitudinal direction of the main body is detected. Therefore, it is possible to detect the amount of skew on the rear end side. This skewed state is monitored, whereby it is possible to, for example, feedback the amount of skew to the image forming portions or perform display on a display unit (not illustrated) so that a user can correct the orientation of the sheet S in the sheet feeding cassette 13 or the multi-feeding unit 17. With this configuration, it is possible to improve and maintain the accuracy of the recording position of an image.

Modification Example 2

Figure 12:
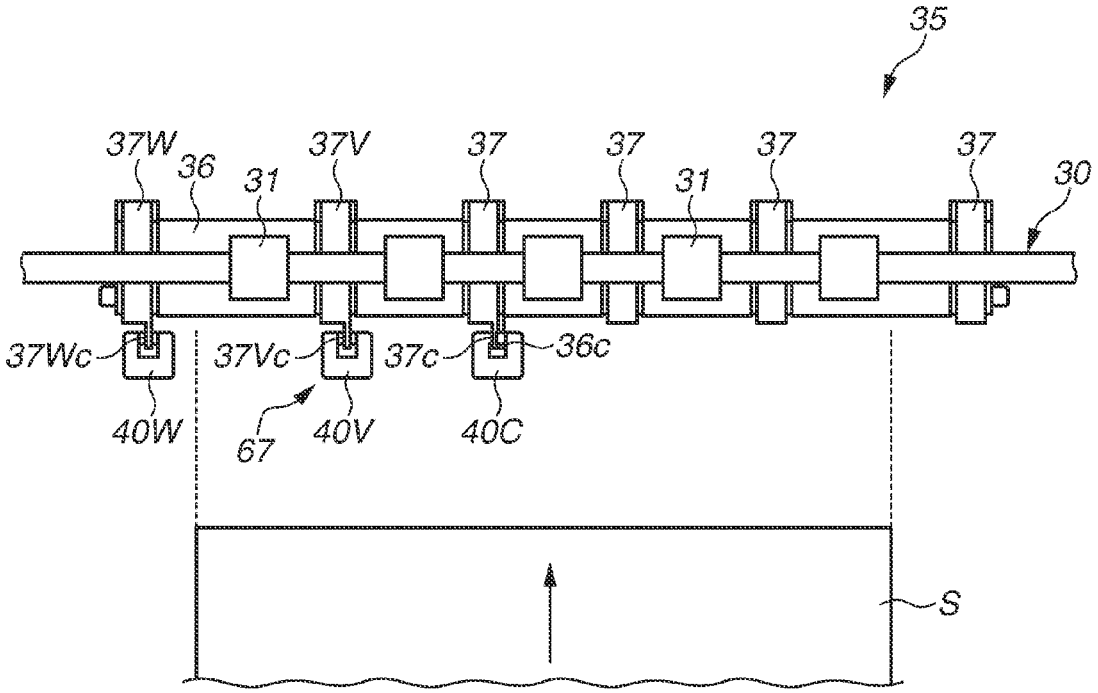
FIG. 12 is a diagram illustrating a relationship between arrangement of photo-interrupters and a sheet according to a modification example 2.
Figure 13:
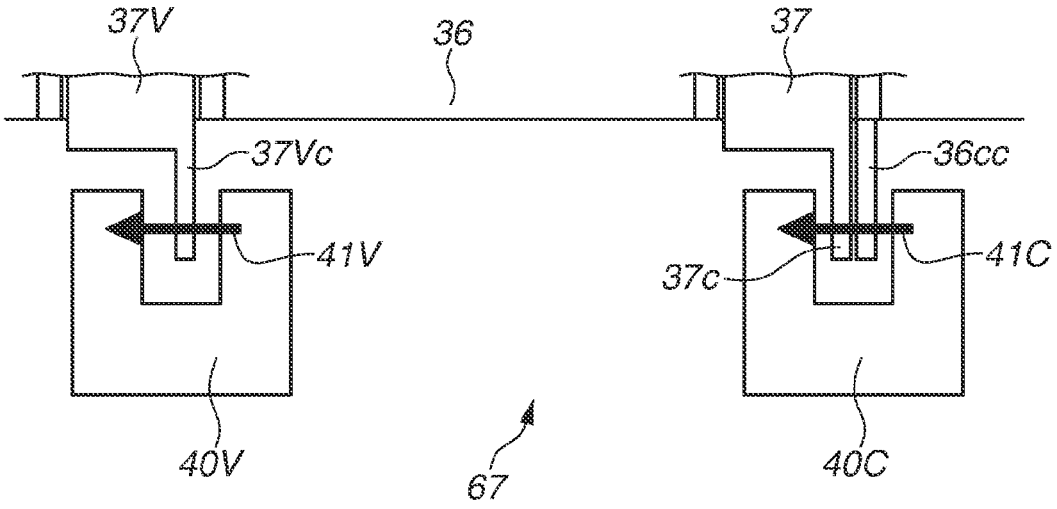
FIG. 13 is a cross-sectional view illustrating a positional relationship in a longitudinal direction between the photo-interrupters, a sheet front end detection portion, and a sheet rear end detection portion according to the modification example 2.
Figure 14:
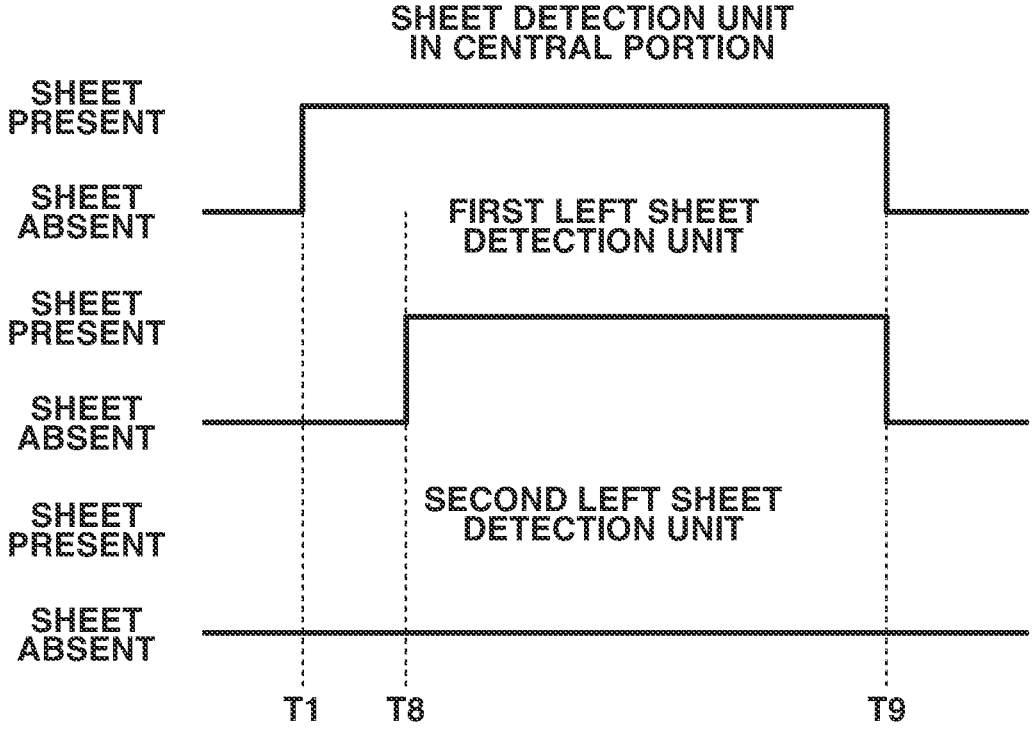
FIG. 14 is a timing chart illustrating a state of the photo-interrupters and determination of presence or absence of a sheet by a control unit according to the modification example 2.

With reference to FIGS. 12, 13, and 14, a modification example 2 of the second exemplary embodiment is described. FIG. 12 is a diagram illustrating an example of a configuration in which three sheet detection units (sheet detection devices) 67 are disposed to side by side on the left side of FIG. 12, and illustrating a state where a sheet S having a narrow width is conveyed.

In the modification example 2, a plurality of shutter members 37 are disposed at predetermined intervals in the axial direction of a pair of registration rollers 20, and a plurality of (three in modification example 2) photo-interrupters are disposed to correspond to a plurality of (three in modification example 2) shutter members among the shutter members 37. Then, a sheet front end detection portion (first flag portion) 36*c* and sheet rear end detection portions (second flag portions) 37*c*, 37Vc, and 37Wc move relative to optical axes of a plurality of corresponding photo-interrupters 40C, 40V, and 40W.

On the left side of a shutter member 37 in a center portion, a shutter member 37V, the sheet rear end detection portion (first left sheet detection unit) 37Vc, which is provided on the shutter member 37V, and the photo-interrupter 40V, which corresponds to the sheet rear end detection portion 37Vc, are disposed. On the left side of the shutter member 37V, a shutter member 37W, the sheet rear end detection portion (second left sheet detection unit) 37Wc, which is provided on the shutter member 37W, and the photo-interrupter 40W, which corresponds to the sheet rear end detection portion 37Wc, are disposed. The sheet front end detection portion 36*c* is disposed to correspond to only the shutter member 37 in the center portion, and is not disposed for the other shutter members 37V and 37W.

FIG. 13 is a diagram illustrating a detailed configuration of the shutter member 37 in the center portion and the shutter member 37V on the left side thereof. An optical axis 41C of the photo-interrupter 40C corresponds to the shutter member 37 in the center portion, and an optical axis 41V of the photo-interrupter 40V corresponds to the shutter member 37V on the left side.

FIG. 14 is a diagram illustrating a determination of the presence or absence of a sheet using each photo-interrupter in the modification example 2. A time T8 is a time when the sheet rear end detection portion 37*c* and the sheet rear end detection portion 37Vc switch the optical axes 41C and 41V, respectively, from light-transmitted states to light-interrupted states. A time T9 is a time when the sheet rear end detection portion 37*c* and the sheet rear end detection portion 37Vc switch the optical axes 41C and 41V, respectively, from the light-interrupted states to the light-transmitted states.

At a time T1, a shutter holder 36 pivots, and the sheet rear end detection portion 37*c*, which is provided adjacent to the shutter member 37 in the center portion, switches the optical axis 41C of the photo-interrupter 40C in the center portion to the light-interrupted state. For the photo-interrupter 40V on the left side and the photo-interrupter 40W further on the left side, a sheet front end detection portion is not provided in the shutter holder 36. Therefore, the photo-interrupter 40V on the left side and the photo-interrupter 40W further on the left side remain in light-transmitted states. In this state, a control unit 44 determines that the front end of a sheet S arrives. Then, at the time T9, the sheet rear end detection portion 37*c* and the sheet rear end detection portion 37Vc switch the optical axes 41C and 41V, respectively, to the light-interrupted states. Therefore, according to the fact that the light transmitting along the optical axis 41V is interrupted, the control unit 44 determines that the sheet S is present in the shutter member 37V.

If the sheet S having a narrow width as in FIG. 12 is conveyed, the sheet S does not pass through the shutter member 37W. Thus, the sheet rear end detection portion 37Wc continues to transmit the light along the optical axis 41W. Thus, the control unit 44 continues to determine that the sheet S is not present in the shutter member 37W. Further, if the sheet S having a narrow width does not pass through the shutter member 37V, only the sheet detection unit 67 in the center portion detects the sheet S. As described above, a plurality of (three in the modification example 2) sheet detection units are disposed in the longitudinal direction, whereby it is possible to detect the presence or absence of a sheet based on the actions of the shutter members 37. With the configuration in which the sheet detection units 67 are provided in the shutter members 37 as sheet skew correction units, it is not necessary to dispose a sheet size detection device at another position. Thus, it is possible to save space.

Further, as this configuration is employed, it is possible to detect the actual width size of a sheet. For example, the control unit 44 notifies a fixing device that the sheet S having a narrow width size will arrive, thereby changing the fixing temperature or changing the sheet conveyance speed. Thus, it is possible to prevent the fixing device from generating abnormal heat only in its end portion. Further, for example, if a sheet the size of which in the width direction is narrow relative to the size recognized by the sheet feeding cassette 13 is conveyed, it is possible to stop conveying the sheet after detecting the size of the sheet and discontinue image formation. Consequently, it is possible to reduce unnecessary consumption of toner.

Modification Example 3

Figure 15A:
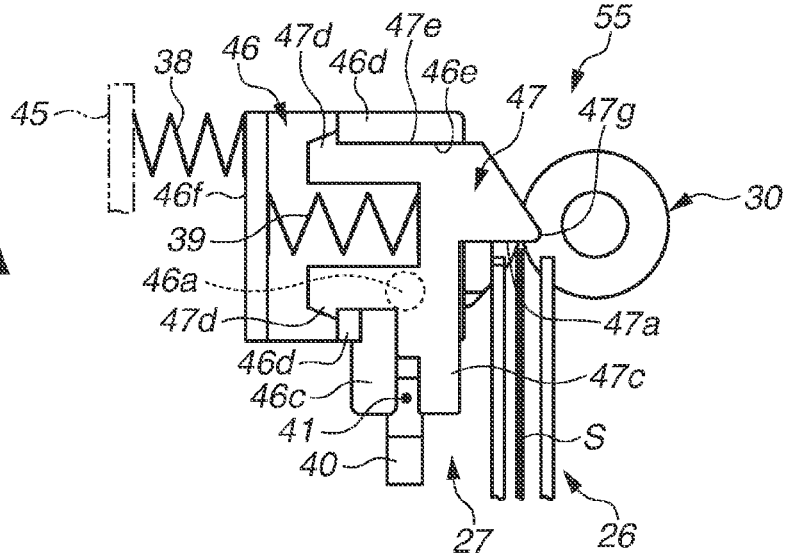
FIG. 15A is a cross-sectional view illustrating a state immediately before a sheet abuts on an abutment surface.
Figure 15B:
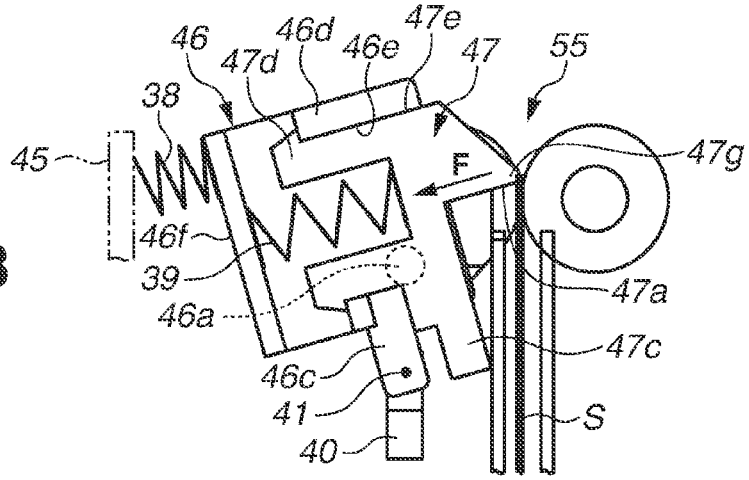
FIG. 15B is a cross-sectional view illustrating a state where, after a shutter holder reaches a separation position, the sheet is conveyed further, and a front end of the sheet goes past the abutment surface.
Figure 15C:
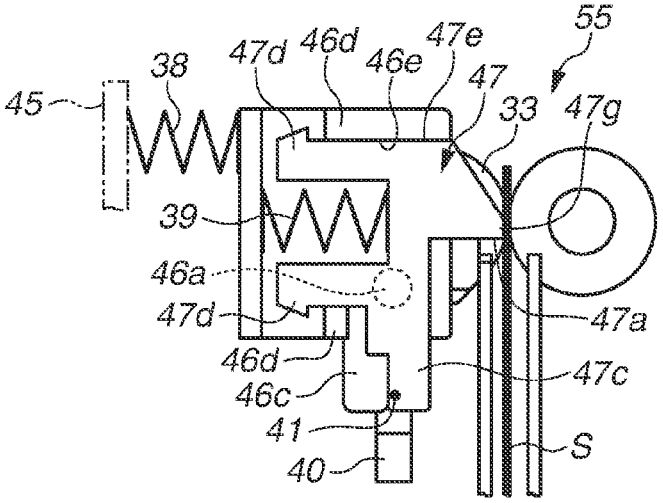
FIG. 15C is a cross-sectional view illustrating a state where the shutter holder returns to a close position, and a shutter member is at a standby position according to a modification example 3.

With reference to FIGS. 15A to 15C, a modification example 3 is described below. FIG. 15A is a cross-sectional view illustrating a state immediately before a sheet S abuts on an abutment surface 47*a* (a protruding position and a close position). FIG. 15B is a cross-sectional view illustrating a state where, after a shutter holder 46 reaches a separation position, the sheet S is conveyed further, and the front end of the sheet goes past the abutment surface 47*a*. FIG. 15C is a cross-sectional view illustrating a state where the shutter holder 46 returns to the close position, and a shutter member 47 is at a standby position.

In the modification example 3, as illustrated in FIGS. 15A to 15C, a registration shutter unit (skew correction unit) 55 is disposed near a pair of registration rollers 20. The registration shutter unit 55 includes a shutter holder (holding member) 46, a shutter member (sheet abutment member) 47, a holder biasing spring (first biasing member) 38, and a shutter biasing spring (second biasing member) 39. The shutter member 47 is supported to be not pivotable but slidable relative to the shutter holder 46.

The shutter holder 46 is supported to be pivotable around a pivotal shaft 46*a* serving as a support point, which is disposed outside a sheet conveyance path 26. The shutter member 47 is supported by the shutter holder 46 to be slidable relative to the pivotal shaft 46*a*, which is disposed outside the sheet conveyance path 26, in the direction of approaching and separating from the sheet conveyance path 26 downstream in the sheet conveyance direction. The holder biasing spring 38 biases the shutter holder 46 holding the shutter member 47 from a separation position (FIG. 15B) toward a close position (FIGS. 15A and 15C). The shutter biasing spring 39 is configured as a spring which biases, from a standby position (FIG. 15C) toward a protruding position (FIG. 15A), the shutter member 47 held to be slidable relative to the shutter holder 46. The shutter biasing spring 39 has a biasing force weaker than that of the holder biasing spring 38.

In the modification example 3, the shutter biasing spring 39 is set to bias the shutter member 47 in the right direction in FIGS. 15A to 15C with a force weaker than the moment of the reaction force of a sheet S. Then, if subjected to the reaction force of the sheet S, the shutter member 47 moves in a sliding manner in the right direction in FIG. 15C. The holder biasing spring 38 is set to have a biasing force stronger than the biasing force of the shutter biasing spring 39 so that also in the state illustrated in FIG. 15C, the holder biasing spring 38 overcomes the biasing force of the shutter biasing spring 39 and pushes back the shutter holder 46 to the close position.

As illustrated in FIGS. 15A to 15C, the shutter holder 46 includes a pair of upper and lower holder-side abutment surfaces 46*d*, which support the shutter member 47 to be movable in a sliding manner to the left and right in FIGS. 15A to 15C relative to a holder-side sliding surface 46*e*. The shutter member 47 includes a pair of upper and lower shutter-side sliding surface 47*e*, which is supported by the holder-side sliding surface 46*e* to be movable in a sliding manner. The holder-side abutment surfaces 46*d* and a shutter-side abutment surface 47*d* are surfaces for abutment the shutter holder 46 when the shutter member 47 is pressed by the shutter biasing spring 39.

In the modification example 3, similar to the above configuration of the pivotable shutters, when the front end of the sheet S abuts on the abutment surface 47*a* of the shutter member 47, then in a state of FIG. 15A, the shutter holder 46 starts pivoting using the pivotal shaft 46*a* as a support point. If the shutter holder 46 pivots to the separation position (FIG. 15B), a sheet front end detection portion 46*c* interrupts the light across an optical axis 41. Then, when the state of FIG. 15B transitions to a state of FIG. 15C, and if the sheet S is conveyed to the position of applying a reaction force to the shutter member 47, the shutter member 47 slides in a direction indicated by an arrow F and interrupts the light across the optical axis 41 when retracting to the standby position. Then, when, in the state of FIG. 15C, the rear end of the sheet passes through a protruding portion 47*g* of the abutment surface 47*a* of the shutter member 47, the shutter member 47 slides to the protruding position in the pressing direction of the shutter biasing spring 39 and switches the optical axis 41 to a light-transmitted state. According to the modification example 3 as described above, it is possible to achieve the configuration in which the size in a height direction (the up-down direction in FIGS. 15A to 15C) is reduced as compared with the case where the shutter member 47 is held to be pivotable.

The sheet conveyance device 71 (see FIG. 1) according to the modification example 3 includes the holder biasing spring (first biasing member) 38 for biasing the shutter holder 46 holding the shutter member 47 from the separation position toward the close position. Further, the sheet conveyance device 71 includes the shutter biasing spring (second biasing member) 39 for biasing the shutter member 47 held to be movable relative to the shutter holder 46 from the standby position toward the protruding position. The shutter biasing spring 39 has a biasing force weaker than that of the holder biasing spring 38. In the sheet conveyance device 71, the shutter biasing spring 39 is provided upstream of the holder biasing spring 38 in the sheet conveyance direction. Thus, the action of the shutter member 47 shifting from the separation position (FIG. 15B) to the standby position (FIG. 15C) is smoother.

In the first and second exemplary embodiments and the modification examples 1 to 3, the color electrophotographic image forming apparatus 1 has been described. However, the present invention is not limited thereto. Alternatively, for example, a monochrome electrophotographic image forming apparatus may be used. Yet alternatively, the configuration may be such that after the control unit 44 detects the front end of a sheet, a signal indicating the start timing of an image forming operation of the image forming unit 70 may be output. Further, in the first and second exemplary embodiments and the modification examples 1 to 3, the above configurations are disposed in a registration shutter unit (skew correction unit). However, the present invention is not limited thereto. Alternatively, for example, the above configurations can be disposed in a fixing discharge sensor or a full-load detection sensor unit after a fixing device in an image forming apparatus in which the distance between sheets is short. Thus, it is possible to achieve a detection configuration with high responsiveness.

While various exemplary embodiments and modification examples of the present invention have been described, however, the present invention is not limited to these exemplary embodiments and modification examples. Further, the effects described in the exemplary embodiments and the modification examples of the present invention are merely a list of the most suitable effects provided by the present invention, and the effects of the present invention are not limited to those described in the exemplary embodiments and the modification examples. For example, in the present exemplary embodiments and the modification examples, the shutter member 37 is held by the shutter holder 36 to be pivotable to the protruding position and the retracted position. However, the present invention is not limited thereto. The present exemplary embodiments have been described using the electrophotographic image forming apparatus 1. However, instead of this, for example, an embodiment can also be applied to an ink-jet image forming apparatus that discharges ink liquid from a nozzle to form an image on a sheet.

According to aspects of the present invention, it is possible to reduce the sheet-to-sheet distance between a preceding sheet and a following sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-216674, filed Nov. 4, 2015, which is hereby incorporated by reference herein in its entirety.

What is claimed is:

1. A sheet detection device configured to detect a sheet conveyed through a sheet conveyance path, the sheet detection device comprising:

an output device configured to output a detection signal that varies by switching the output device between a light-interrupted state where an optical path is interrupted and a light-transmitted state where the optical path is not interrupted;

an abutment member including an abutment surface for abutting a front end of the conveyed sheet;

a holding member including a first positioning portion and configured to hold the abutment member; and a detection unit configured to detect presence or absence of the sheet based on the detection signal output from the output device, wherein the holding member includes a first flag portion capable of switching the optical path between the light-interrupted state and the light-transmitted state, wherein the abutment member includes a second flag portion capable of switching the optical path between the light-interrupted state and the light-transmitted state, wherein the abutment member is movable to an abutment position at which the abutment surface abuts on the front end of the sheet, and is positioned relative to the first positioning portion, and also movable to a retracted position at which the abutment surface does not abut on the front end of the sheet, wherein the holding member is movable to a positioned first position and a second position retracted from the first position, wherein, in a standby state where the abutment member is located at the abutment position and the holding member is located at the first position, the abutment surface is pushed by the front end of the sheet whereby, in a state where the abutment member is positioned by the first positioning portion, the holding member moves in a direction away from the first position, and wherein the holding member moves in the direction away from the first position and thereby causes the front end of the sheet to separate from the abutment surface, whereby, in a state where the abutment member is pushed by a surface of the sheet and thereby moves to the retracted position, the holding member moves from the second position to the first position and, based on the detection signal output from the output device by the first flag portion and the second flag portion moving relative to the optical path with movements of the abutment member and the holding member, the detection unit detects the presence or absence of the sheet.

2. The sheet detection device according to claim 1, wherein the holding member is supported to be pivotable using, as a support point, a pivotal shaft disposed outside the sheet conveyance path, and wherein the abutment member is supported by the holding member to be pivotable using as a support point a pivotal spindle disposed downstream, in a sheet conveyance direction, of the pivotal shaft disposed outside the sheet conveyance path, the sheet detection device further comprising:

a first biasing member configured to bias the holding member holding the abutment member; and a second biasing member configured to bias, from the retracted position toward the abutment position, the abutment member held to be movable relative to the holding member.

3. The sheet detection device according to claim 2, wherein a biasing force of the second biasing member is weaker than a biasing force of the first biasing member.

4. The sheet detection device according to claim 1, wherein the holding member is supported to be pivotable around a pivotal shaft, wherein the pivotal shaft serves as a support point and is disposed outside the sheet conveyance path, and wherein the abutment member is supported by the holding member to be slidable in a direction of approaching or separating from the sheet conveyance path downstream, in a sheet conveyance direction, of the pivotal shaft disposed outside the sheet conveyance path, the sheet detection device further comprising:

a first biasing member configured to bias the holding member holding the abutment member; and a second biasing member configured to bias, from the retracted position toward the abutment position, the abutment member held to be slidable relative to the holding member, wherein the second biasing member has a biasing force weaker than a biasing force of the first biasing member.

5. The sheet detection device according to claim 1, wherein, when the abutment surface is pressed by the front end of the conveyed sheet and the abutment member moves from the abutment position to the retracted position, the holding member moves together with the abutment member to the second position and switches the output device to the light-interrupted state by the first flag portion, and wherein, immediately after the abutment surface is pressed by the front end of the conveyed sheet, the detection unit determines that the sheet is present.

6. The sheet detection device according to claim 1, wherein, when the output device is switched from the light-transmitted state to the light-interrupted state by a movement of the first flag portion, the detection unit determines that the front end of the sheet conveyed through the sheet conveyance path arrives, and when the output device is switched from the light-interrupted state to the light-transmitted state by a movement of the second flag portion, the detection unit determines that a rear end of the sheet conveyed through the sheet conveyance path has passed.

7. The sheet detection device according to claim 1, further comprising a pair of conveyance rollers configured to nip at a nip portion of the sheet conveyed through the sheet conveyance path and having passed through the abutment surface while abutting the abutment surface, and convey the sheet downstream in a sheet conveyance direction, wherein the abutment member is a shutter member configured to convey, at the abutment position, the sheet to the nip portion while causing the front end of the sheet to abut on the abutment surface located upstream of the nip portion and correcting a skew of the sheet.

8. The sheet detection device according to claim 7, wherein as the shutter member, a plurality of shutter members are disposed at predetermined intervals in an axial direction of the pair of conveyance rollers, wherein as the output device, a plurality of output devices are disposed to correspond to a plurality of shutter members among the shutter members, and wherein the first flag portion and the second flag portion move with respect to the optical paths of the plurality of corresponding output devices.

9. The sheet detection device according to claim 1, wherein as the shutter member, a plurality of shutter members are disposed at predetermined intervals in an axial direction of a pair of conveyance rollers, wherein as the output device, a single output device is disposed to correspond to a shutter member located in a center portion in the axial direction, among the plurality of shutter members, and wherein the first flag portion and the second flag portion each move with respect to the optical path of the single output device.

10. A sheet conveyance device comprising:

the sheet detection device according to claim 1; and a conveying unit configured to convey a sheet to the sheet detection device.

11. An image forming apparatus comprising:

the sheet conveyance device according to claim 1; and an image formation unit configured to form an image on a sheet detected by the output device.

12. The image forming apparatus according to claim 11, wherein, based on a detection signal from the output device, the detection unit controls the image formation unit to start an image forming operation for forming an image on a sheet.

13. The image forming apparatus according to claim 12, wherein, based on the detection signal from the output device, the detection unit controls a sheet conveyance speed to accelerate or decelerate in synchronized timing with the image formed by the image formation unit.

* * * * *